US007284496B1

(12) United States Patent
Douceur

(10) Patent No.: US 7,284,496 B1
(45) Date of Patent: Oct. 23, 2007

(54) FAIL-SAFE REMOTELY CONTROLLED CHAIN STOPPER WITH POSITION INDICATOR

(76) Inventor: John R. Douceur, 14705 NE. 16th St., Bellevue, WA (US) 98007

( * ) Notice: Subject to any disclaimer, the term of this patent is extended or adjusted under 35 U.S.C. 154(b) by 540 days.

(21) Appl. No.: 11/026,755

(22) Filed: Dec. 31, 2004

(51) Int. Cl.
*B63B 21/18* (2006.01)
*B63B 21/24* (2006.01)

(52) U.S. Cl. ..... 114/200; 114/293

(58) Field of Classification Search ..... 114/200
See application file for complete search history.

(56) References Cited

U.S. PATENT DOCUMENTS

| | | | |
|---|---|---|---|
| 9,645 | A | 4/1853 | Crane |
| 13,847 | A | 11/1855 | Jackson |
| 16,821 | A | 3/1857 | Gilmour |
| 23,894 | A | 5/1859 | Bentley et al. |
| 106,514 | A | 8/1870 | Shipman |
| 140,202 | A | 7/1873 | Kilner |
| 346,685 | A | 8/1886 | Robbins |
| 2,623,255 | A | 12/1952 | Thomsen |
| 2,718,865 | A | 9/1955 | Kurzmann |
| 2,893,341 | A | 7/1959 | Anderson |
| 2,938,491 | A | 5/1960 | Scanlin |
| 2,938,606 | A | 5/1960 | Passman |
| 2,949,989 | A | 8/1960 | Lindstrom et al. |
| 2,955,560 | A | 10/1960 | Howington et al. |
| 3,046,929 | A | 7/1962 | Piver |
| 3,337,010 | A | 8/1967 | Wrensch |
| 3,638,599 | A | 2/1972 | Nilsen |
| 3,803,942 | A | 4/1974 | Duggan |
| 3,805,728 | A | 4/1974 | Abraham |
| 3,820,494 | A | 6/1974 | Hall et al. |
| 3,859,946 | A | 1/1975 | Hammerschlag |
| 4,070,981 | A | 1/1978 | Guinn et al. |
| 4,186,464 | A | 2/1980 | Sandoy |
| 4,290,380 | A | 9/1981 | Bolen |
| 4,387,659 | A | 6/1983 | Terauchi et al. |
| 4,423,697 | A | 1/1984 | Royset |
| 4,531,470 | A | 7/1985 | Paul |
| 4,827,861 | A | 5/1989 | Goode |
| 5,062,375 | A | 11/1991 | Makielski |
| 5,365,872 | A | 11/1994 | Obrinski |
| 5,809,925 | A | 9/1998 | Montgomery |
| 5,934,216 | A | 8/1999 | Childers et al. |
| 6,425,339 | B1 | 7/2002 | Furlong et al. |
| 6,435,121 | B2 | 8/2002 | Siring |
| 6,810,826 | B1 | 11/2004 | Bellis |

FOREIGN PATENT DOCUMENTS

| | | | |
|---|---|---|---|
| GB | 2131380 | A * | 6/1984 |

* cited by examiner

*Primary Examiner*—Jesús D Sotelo

(57) ABSTRACT

A device for mechanically securing an anchor chain on a watercraft under control from one or more remote locations, additionally providing remote indication of whether the chain is secured and whether the chain is free to move. Furthermore, when the watercraft is under way, the device restrains the anchor from accidentally launching from its storage position, thereby obviating the need for a safety cable. The device is electrically fail-safe, in that it continues to secure the anchor under conditions of electrical failure. Key components of the device include a frame and rotatable pawl for securing the chain, a spring to urge the pawl toward a position that secures the chain, a solenoid that can urge the pawl toward a position that frees the chain, and a switch to control the solenoid. The invention provides methods for weighing anchor, dropping anchor, increasing anchor scope, and reducing anchor scope.

20 Claims, 15 Drawing Sheets

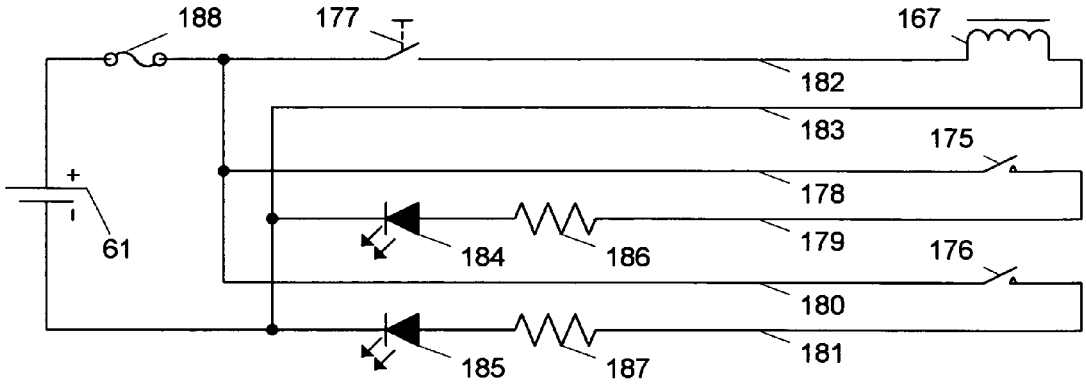
Fig. 12
Fig. 13
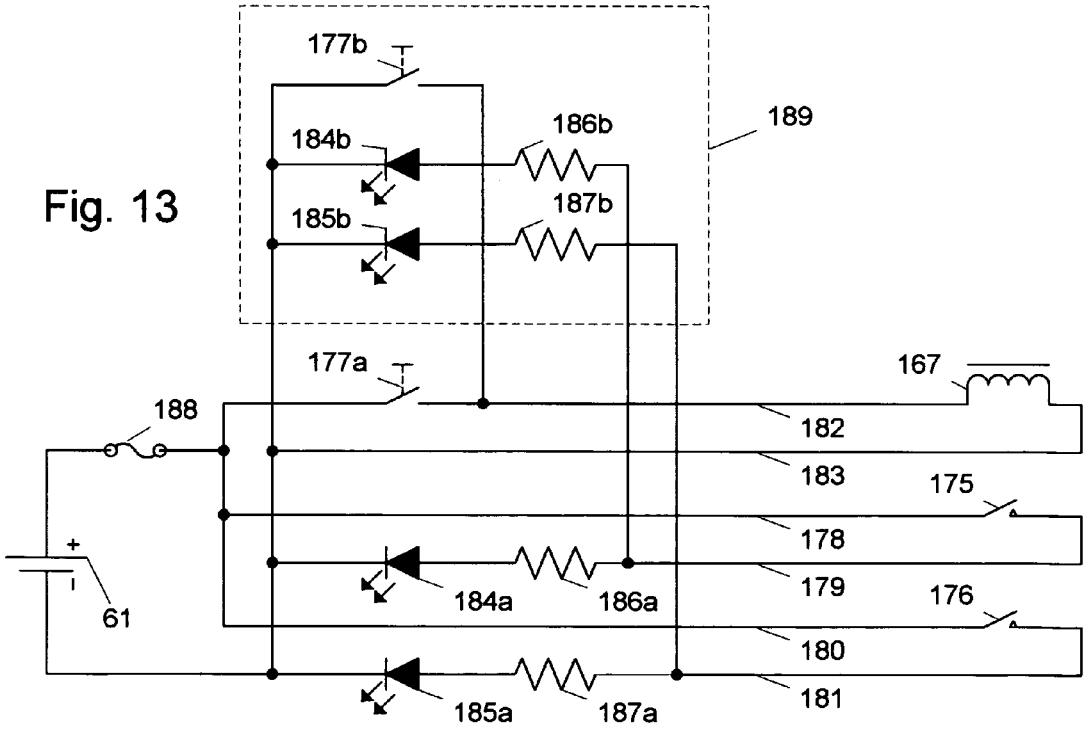

Fig. 17
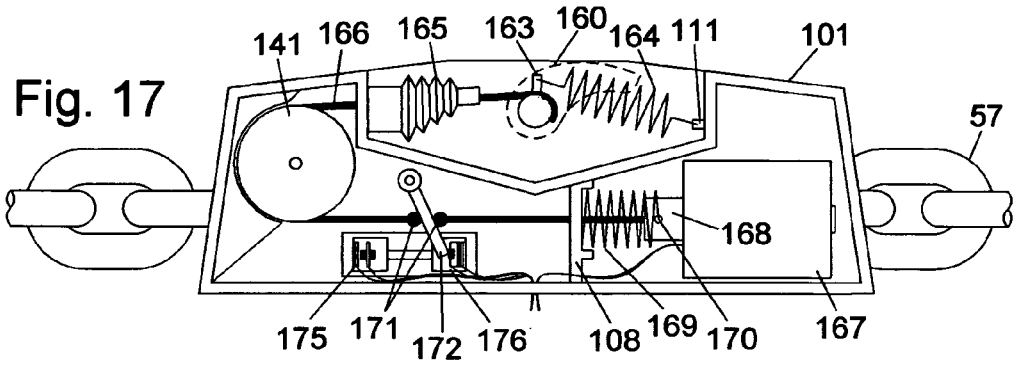
Fig. 18
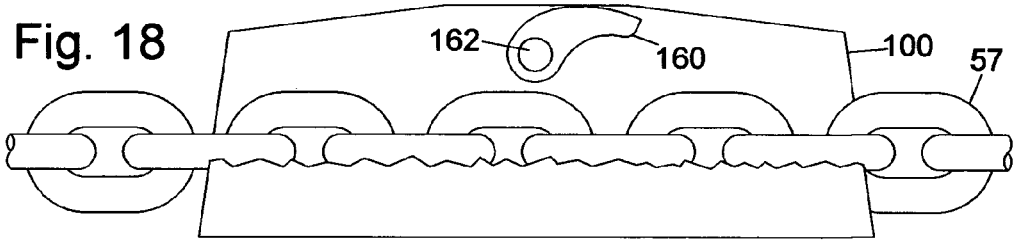
Fig. 19
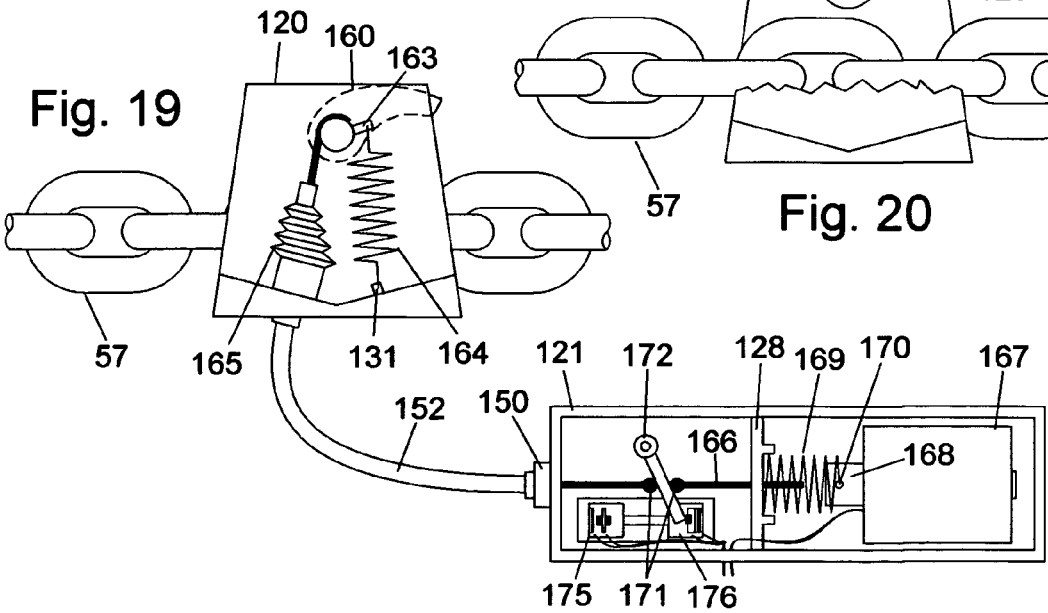
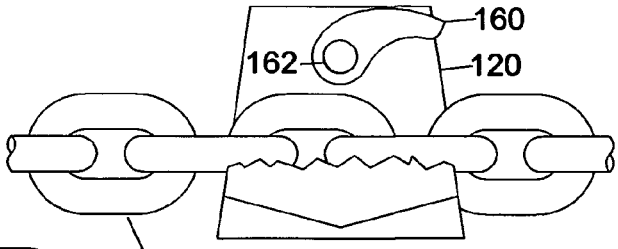
Fig. 20

Fig. 21
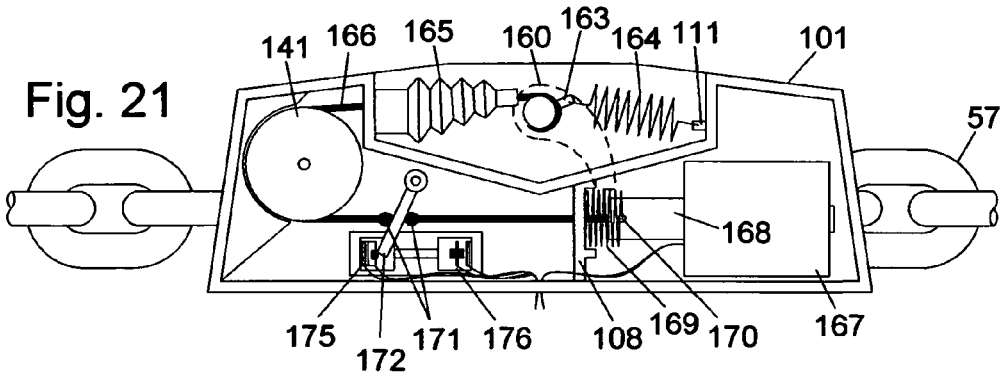
Fig. 22
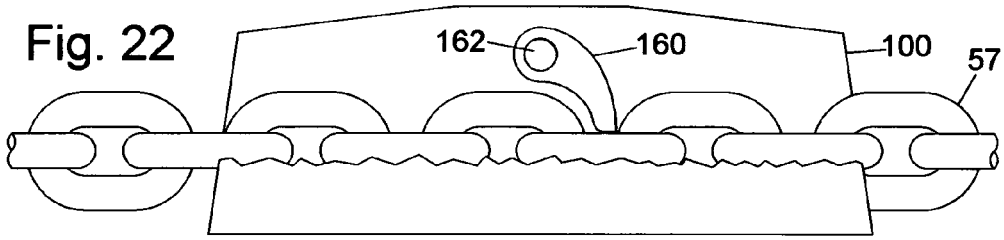
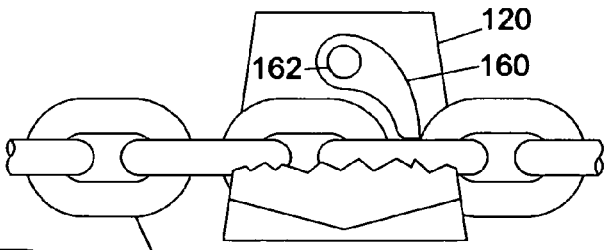
Fig. 24
Fig. 23
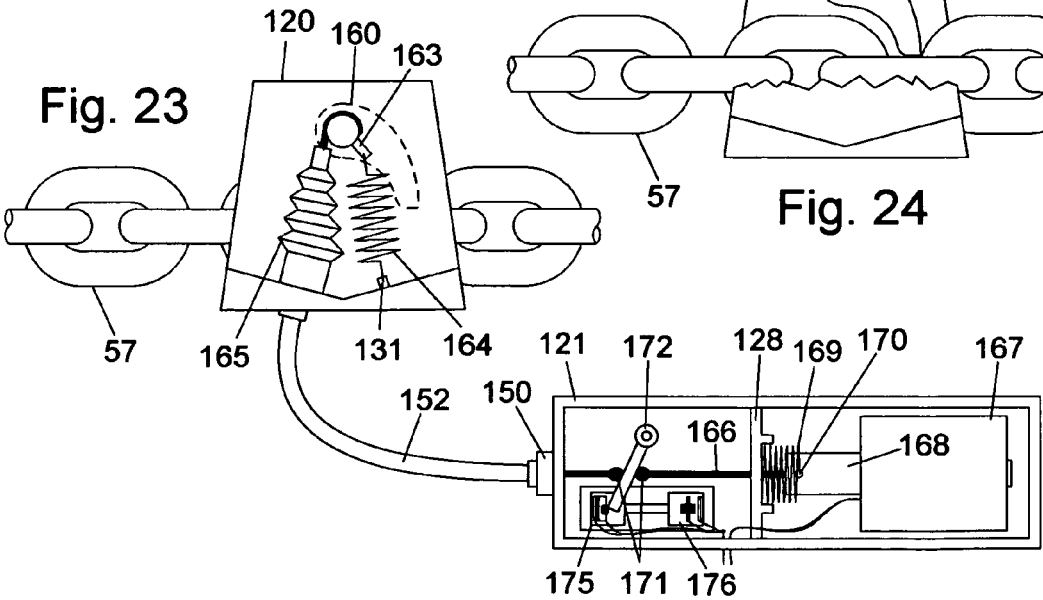

Fig. 25
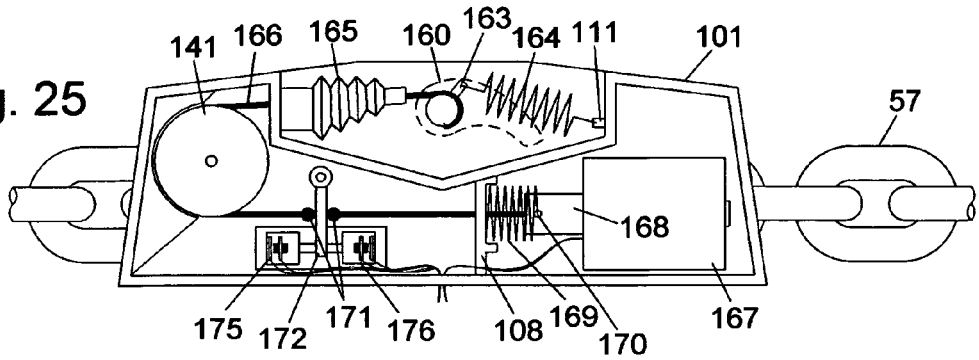
Fig. 26
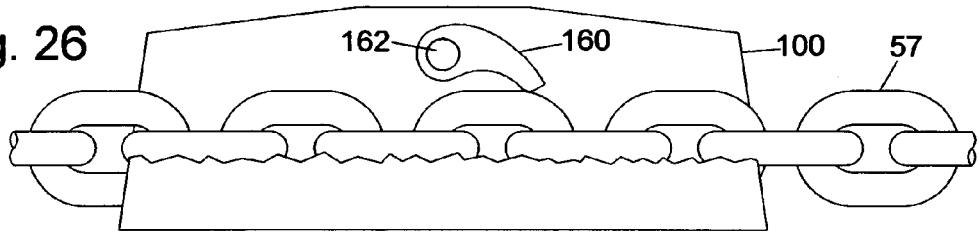
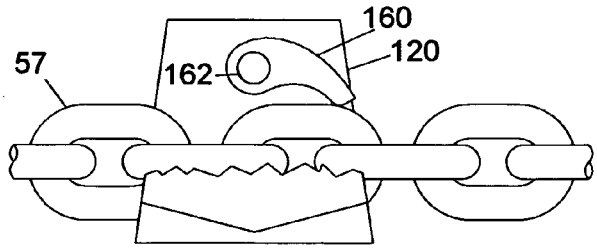
Fig. 28
Fig. 27
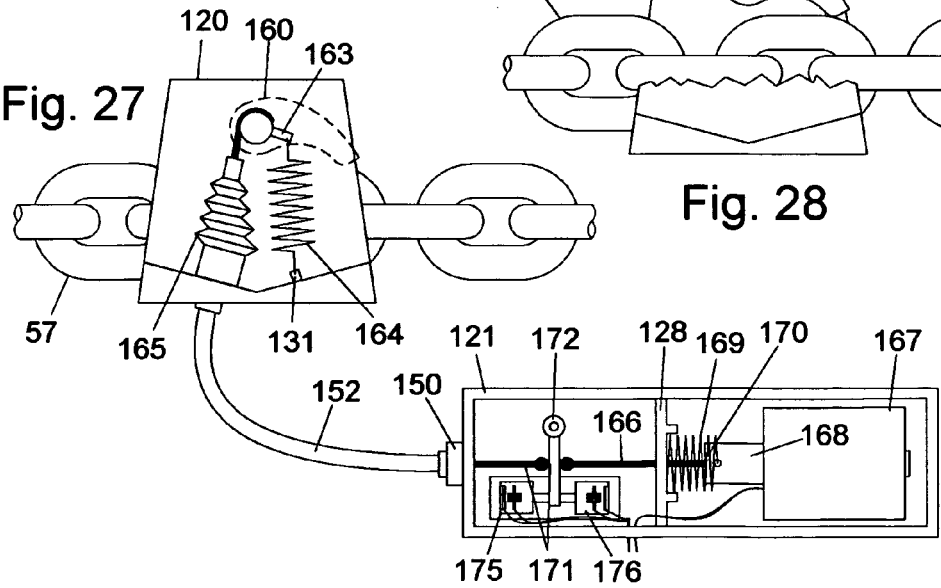

FAIL-SAFE REMOTELY CONTROLLED CHAIN STOPPER WITH POSITION INDICATOR

CROSS-REFERENCE TO RELATED APPLICATIONS

Not Applicable

SEQUENCE LISTING OR PROGRAM

Not Applicable

TECHNICAL FIELD

This invention relates generally to anchoring systems for watercraft, specifically to chain stoppers and related devices for securing anchor chain on mid-size vessels, such as boats from about 10 meters to about 25 meters in length.

BACKGROUND OF THE INVENTION

Prior Art

Prior Art Anchoring Systems

When a watercraft is neither in port nor under way, it is often desirable to limit the motion of the craft to prevent it from drifting into unsafe waters. Typically, boats use anchoring systems to limit their motion, thereby remaining in an approximately fixed position despite the influence of wind and current.

For much of the twentieth century, anchoring systems for mid-size boats typically comprised an anchor, anchor line, and a cleat attached to the boat's foredeck. To anchor a boat with such a system, an operator of the boat would drop anchor by casting the anchor overboard, manually paying out a length of line, and securing the line to the cleat. Over the past few decades, mid-size-boat anchoring systems have become more sophisticated, as they have incorporated features that were previously common only on larger vessels. On many boats, anchor chain has replaced anchor line; the chain is payed out and hauled in by a windlass rather than by hand; and the windlass is driven by electrical power rather than by a manual crank.

FIG. 1 shows a side elevation view of a typical mid-size boat 50, illustrated in very limited detail except for bow area 52, where its anchoring system is located. Illustrated components of the anchoring system include anchor 56, chain 57, and windlass 58. When not in active use, anchor 56 is housed in pulpit 55, from which it is launched when chain 57 is payed out by windlass 58. Windlass 58 is shown mounted on foredeck 53; however, windlasses on some vessels may be mounted in other locations, such as on a platform below the foredeck, or on the side or stem of the vessel. Moreover, many other arrangements of anchor, chain, and windlass are possible, involving platforms, bow sprits, fairleads, anchor rollers, and other supplementary equipment. The depiction in FIG. 1 is intended for explanatory purposes only.

FIG. 2 illustrates a partial view, in larger scale, of bow area 52 of boat 50 shown in FIG. 1. This figure is a partial-sectional side elevation view, revealing components normally shielded from view by hull 54. As FIG. 2 shows, below foredeck 53 is a locker 59, which is isolated from other interior regions of the boat by a bulkhead 60. Windlass 58 is shown mounted through foredeck 53, extending into locker 59; however, other styles of windlasses may be located entirely above foredeck 53. When windlass 58 hauls in anchor chain 57, windlass 58 deposits chain 57 inside locker 59, where it is stored when not in active use.

Relative to anchor windlasses on larger vessels, windlasses for mid-size boats are typically not very powerful and not very robust, mainly for reason of affordability. Because they lack power, windlasses are typically assisted by the boat's engines when hauling in anchor. In this capacity, engines are used for two purposes: First, under conditions of high wind or strong current, the engines are used to move the boat toward the location in the seabed at which the anchor is buried; this slackens the anchor chain and allows the windlass to haul in the chain without excessive power. Second, if the anchor is deeply buried in the seabed, after the chain is hauled in about as far as it can be, the engines are used to move the boat away from the location in the seabed at which the anchor is buried; this pulls the anchor out of the seabed, after which the windlass is used to haul in the remainder of the chain. When operated in this fashion, the windlass requires only as much power as is necessary to lift the weight of the anchor and chain.

Because they lack robustness, windlasses do not bear up well under force on the anchor chain when the boat is laying at anchor and being pushed by a high wind or a strong current, or when the boat's engines are used to pull the anchor out of the seabed. Under these conditions, the strain can be great enough to permanently bend a spindle inside the windlass, thereby damaging the windlass. For this reason, windlasses are typically augmented by a mechanism that absorbs the load and thereby relieves the windlass of strain. Several such mechanisms exist, but one of the simplest and most effective is a chain stopper.

Over time, many varieties of chain stopper have been designed. A chain stopper for a mid-size boat typically comprises a frame, which is affixed to the boat's foredeck, and a pawl, one end of which is rotatably mounted inside the frame. The anchor chain passes through the frame so that, when the pawl is flipped down, the free end of the pawl catches a link of the chain. As the chain is payed out slightly, the free end of the pawl becomes held in place by the force on the chain. The pawl then prohibits the chain from paying out further.

Lack of robustness can also lead to another problem. Windlasses have an occasional tendency to accidentally release a length of anchor chain when the chain is subject to sudden physical shocks. This problem does not merely occur when the boat is at anchor; it can also occur while the boat is under way, especially if the boat is in rough seas. Under the latter circumstance, the anchor can be accidentally launched from its storage position, which can cause at least three problems: First, if the length of anchor chain accidentally released is relatively short, the anchor will dangle in front of the boat, and if the boat is pitching in rough water, the anchor may swing into the bow of the boat and damage the hull. Second, if the length of anchor chain is somewhat longer, the anchor may be pushed by water pressure toward the stern of the boat, where it could damage the boat's propellers. Third, if the length of anchor chain is sufficiently long, it could fall to the bottom of the water, bury in the seabed, and impart a tremendous strain to the bow of the vessel that is under way, thereby causing severe damage to the boat.

For this reason, windlasses are typically augmented by an additional mechanism that prevents the anchor from accidentally launching while the boat is under way. Several such mechanisms exist, but one of the most common is a safety cable. One end of the safety cable is made fast to the foredeck of the boat, and the other end is connected to a shackle. When the boat is under way, the shackle is fastened to the anchor chain at a point near the anchor, so that if the windlass releases a length of anchor chain, the safety cable will restrain the anchor from launching.

FIG. 3 is a partial-sectional side elevation view of bow area 52, wherein the anchoring system is augmented by prior-art chain stopper 80 and prior-art safety cable 81 mounted on foredeck 53.

Despite the relative lack of power and lack of robustness of mid-size-boat windlasses, they are in common use, in large part because of their convenience. One common feature that putatively increases the convenience of a windlass is a remote control, typically mounted in the bridge area of the boat, which allows the operator of the boat to control the pay-out and haul-in of the anchor in tandem with control of the boat's engines. As explained above, controlling the windlass and engines in tandem is often necessary, due to the lack of power of commonly installed windlasses.

As shown in FIG. 1, bridge 51 is remote from foredeck 53. There is putative benefit in enabling a boat's operator to control windlass 58, mounted on foredeck 53, without leaving bridge 51.

However, because windlasses typically require a chain stopper or similar device to absorb load, and because they also typically require a safety cable or similar device to prevent accidental launching of the anchor, it is not normally possible to operate a windlass, in a safe manner, entirely from the bridge. A typical anchoring procedure for a single boat operator may proceed as follows: After arriving at an anchorage, the operator of the boat prepares the anchor for release by disconnecting the safety cable from the anchor chain. This step requires the operator to walk to the bow of the boat to disconnect the safety cable. Next, the operator returns to the bridge to operate the windlass and engines. Once the windlass has payed out a length of anchor chain that the operator believes to be sufficient for anchoring, the operator sets the anchor. Depending on anchoring conditions, this step might require putting the engines in reverse, or it might require only putting the engines in neutral and letting the wind or current pull the boat to dig the anchor in. However, in either case, there will be a substantial force on the anchor chain, so it is first necessary for the operator to walk to the bow and flip down the pawl of the chain stopper, and then return to the bridge to operate the windlass and engines. If it happens that the operator made an incorrect judgment of how much anchor chain to pay out, such that more anchor chain is needed, the operator must use the engines and windlass control to retract the chain slightly, thereby freeing the pawl of the chain stopper, then walk to the bow of the boat to flip up the pawl, and then return to the bridge to pay out more anchor chain, then return to the bow to flip down the pawl, and then return once again to the bridge to operate the windlass and engines.

If a second person is on board, many of the trips back-and-forth between the bridge and the bow can be eliminated by stationing one person at the bridge and one person at the bow. However, this requires very precise communication between the two people for the anchoring procedure to be performed effectively and safely.

Furthermore, even with a second person on board, venturing to the bow can be dangerous if the boat is making an emergency anchoring in heavy seas. On many boats, walking to the bow requires negotiating a narrow walkway on the side of the boat, which can be difficult if the boat is moving roughly or is being splashed by waves. Similarly, boat bows are typically not well protected, which can make operating the safety cable and the chain stopper difficult and dangerous when waves are crashing over the bow.

For these reasons, it is advantageous to provide a mechanism that allows remote control of the chain stopper or other device for absorbing load and also of the safety cable or other device for prevent accidental launching of the anchor.

Prior to the present invention, there has been no such device that is suitable for use on mid-size boats.

The prior art includes several remotely controlled chain stoppers, but all have disadvantages relative to the present invention. U.S. Pat. Nos. 9,645 (1853) to Crane, 23,894 (1859) to Bentley et al., 140,202 (1873) to Kilner, 346,685 (1886) to Robbins, 2,718,865 (1955) to Kurzmann, 2,893,341 (1959) to Anderson, and 6,435,121 B2 (2002) to Siring provide remote control of a chain stopper via a mechanical cable. Manipulating the cable from a boat's bridge necessitates a pulley arrangement or other load-transmission mechanism. Such a mechanically restrictive connection may be challenging to route, difficult to maintain, and awkward to use. This disadvantage also applies to U.S. Pat. No. 3,046,929 (1962) to Piver, which also provides remote control via a mechanical cable, although it is not intended specifically for use in an anchoring system. The Anderson patent is also noteworthy in that it states, " . . . it is a primary object of the present invention to provide a control by means of which the anchor can be lowered or raised from a position beyond the bow without the operator being required to go forward and stand on the deck at the bow of the boat." This text clearly indicates that this problem is considered relevant and important among those skilled in the art.

U.S. Pat. No. 2,938,491 (1960) to Scanlin, despite its claim to provide " . . . means that will enable a user to raise and lower the anchor from any desired pre-selected position in the boat," does not provide remote control. Instead, it requires running the anchor line to the intended control position. This same criticism applies to U.S. Pat. Nos. 2,955,560 (1960) to Howington et al., 4,290,380 (1981) to Bolen, and 5,062,375 (1991) to Makielski.

U.S. Pat. Nos. 3,805,728 (1974) to Abraham, 4,070,981 (1978) to Guinn et al., 4,423,697 (1984) to Royset, and 5,934,216 (1999) to Childers et al. provide power control of a chain stopper through hydraulics or pneumatics, requiring a pump or pressurized cylinder, which are not commonly found on mid-size watercraft. These devices are intended for high-power, high-load applications. Although such mechanisms may be suitable for large vessels and floating platforms, their weight, expense, and power requirements makes them unsuitable for use on mid-size boats. Furthermore, these devices are not fail-safe. If power to the hydraulic or pneumatic actuator is lost while the chain stopper is disengaged, the chain stopper will remain disengaged.

U.S. Pat. No. 6,810,826 B1 (2004) to Bellis describes a mechanism for deploying and retrieving anchor without leaving the bridge. However, this mechanism is suitable only for small boats that lack windlasses and that use anchor line rather than anchor chain. It is not suitable for use on mid-size boats.

Many devices in the prior art include a mechanism that can remotely release a chain or cable in a single use, but which then must be manually reset before being used again. Such devices include U.S. Pat. Nos. 13,847 (1855) to Jackson, 106,514 (1870) to Shipman, 2,623,255 (1952) to Thomsen, 3,803,942 (1974) to Duggan, 3,820,494 (1974) to Hall et al., 3,859,946 (1975) to Hammerschlag, 4,186,464 (1980) to Sandoy, 4,387,659 (1983) to Terauchi et al., 4,531,470 (1985) to Paul, 4,827,861 (1989) to Goode, 5,365,872 (1994) to Obrinski, and 5,809,925 (1998) to Montgomery. These devices cannot remotely stop a chain or cable. By contrast, U.S. Pat. No. 16,821 (1857) to Gilmour can remotely stop a chain in a singe use, but it cannot remotely release the chain; this device also must be manually reset before being used again.

U.S. Pat. Nos. 3,638,599 (1972) to Nilsen and 6,425,339 B1 (2002) to Furlong et al. describe chain stoppers that can also restrain an anchor from accidentally launching. Neither device provides any form of remote control.

Outside of marine applications, prior inventors have observed the value of low-cost, lightweight mechanisms for remotely controlling pawls. U.S. Pat. Nos. 2,938,606 (1960) to Passman, 2,949,989 (1960) to Lindstrom et al., and 3,337,010 (1967) to Wrensch describe pawls that are actuated by springs and released by solenoids. These pawls are used for stopping the rotation of discs, not for stopping longitudinal movement of chain, for which they would be ill-suited. In addition, they lack means to protect their sensitive electrical parts from mechanical shock or water damage. Thus, they are unsuitable for use as anchor-chain stoppers.

Moreover, none of the above-described prior-art mechanisms include means for indicating the state of the pawl to the operator of the device. To properly coordinate use of a chain stopper with use of a windlass and use of a boat's engines, it is important for the operator to know when the chain is free to move and when the chain has been locked by the chain stopper.

OBJECTS AND ADVANTAGES

Accordingly, several objects and advantages of the present invention are:

(a) to provide an inexpensive and lightweight mechanism that enables an anchor chain to be secured under control from one or more remote locations, such as a vessel's bridge;

(b) to provide a mechanism that remote-controllably restrains an anchor from accidentally launching;

(c) to provide means for both stopping and releasing an anchor chain under remote control;

(d) to provide a mechanism that can be used repeatedly without requiring manual reset;

(e) to exploit the presence of a powered windlass to enable use of a relatively weak actuator for securing the chain;

(f) to avoid a mechanically restrictive connection between the point of anchor securing and the point of control;

(g) to avoid running the anchor chain to the control location or to any other location on the vessel, other than to the windlass and anchor locker;

(h) to exploit the presence of electric power commonly found at the bow of mid-size boats, rather than requiring pressurized fluid, which is not commonly found on mid-size boats;

(i) to provide to the vessel operator an indication of whether the anchor chain is secured and whether it is free to move;

(j) to enable securing of anchor chain to be controlled electronically by an automated anchoring system;

(k) to continue to operate even when subject to repeated mechanical shocks and water immersion; and (l) to provide fail safety, so that the device will secure the anchor chain even under conditions of power failure.

Further objects and advantages of the invention will become apparent from a consideration of the drawings and ensuing description.

SUMMARY OF THE INVENTION

The invention provides a device for mechanically securing an anchor chain on a watercraft. Key components of the invention include a frame, a pawl, a spring, a solenoid, and a control switch. The pawl is rotatably mounted in the frame so that it can rotate to an unlocked position, to a locked position, and through a range of intermediate positions. When the frame is mechanically attached to a watercraft and an anchor chain is passed through the frame, the pawl in unlocked position permits outward and inward movement of the chain, and the pawl in locked position impedes outward movement of the chain. The spring is mechanically coupled to the pawl so that it urges the pawl toward the locked position. The solenoid is mechanically coupled to the pawl so that, when engaged, it urges the pawl toward the unlocked position. The control switch is electrically coupled to the solenoid so that, when closed, it engages the solenoid. The anchor chain can thus be secured under control of the control switch.

While the watercraft is under way and the anchor is completely raised, in accordance with the invention, the control switch is left open. The solenoid is thus not energized, so the pawl is urged toward the locked position by the spring. If a sudden physical shock causes the windlass to accidentally release a length of anchor chain, the outward movement of the chain permits the force from the spring to rotate the pawl into locked position, thereby restraining the anchor from accidentally launching from its storage position.

In accordance with the invention, the solenoid is not energized under conditions of electrical failure. Because the spring urges the pawl toward the locked position, the device impedes significant outward movement of the chain under such conditions. Thus, the device is electrically fail-safe.

Furthermore, the invention provides means for detecting whether the pawl is in locked position and whether the pawl is in unlocked position. In one incarnation, the mechanical coupling between the solenoid and the pawl is by means of a cable. A paddle is mechanically coupled to the cable, and position-detection switches are positioned on either side of the paddle, such that one position-detection switch is closed when the pawl is in the locked position, and the other position-detection switch is closed when the pawl is in the unlocked position.

In accordance with the invention, means are provided for protecting the solenoid and possibly other components from damage due to water, and means are also provided for protecting the spring and possibly other components from mechanical damage.

The invention additionally provides methods for weighing anchor, dropping anchor, increasing anchor scope, and decreasing anchor scope.

BRIEF DESCRIPTION OF THE DRAWINGS

FIG. 12 is a schematic circuit diagram showing electrical connections in embodiments of the invention involving a single control station.

FIG. 13 is a schematic circuit diagram showing electrical connections in embodiments of the invention involving multiple control stations.

FIG. 17 is an elevation view of the first embodiment with pawl 160 in unlocked position; chain 57 is additionally shown, but lid 103 and shield 104 are not shown.

FIG. 18 is an elevation view of components of the first embodiment; shown are frame 100 in partial section, rod 162, and pawl 160 in unlocked position; chain 57 is additionally shown.

FIG. 19 is an elevation view of the second embodiment with pawl 160 in unlocked position; chain 57 is additionally shown, but lid 123 and shield 124 are not shown.

FIG. 20 is an elevation view of components of the second embodiment; shown are frame 120 in partial section, rod 162, and pawl 160 in unlocked position; chain 57 is additionally shown.

FIG. 21 is an elevation view of the first embodiment with pawl 160 in locked position; chain 57 is additionally shown, but lid 103 and shield 104 are not shown.

FIG. 22 is an elevation view of components of the first embodiment; shown are frame 100 in partial section, rod 162, and pawl 160 in locked position; chain 57 is additionally shown.

FIG. 23 is an elevation view of the second embodiment with pawl 160 in locked position; chain 57 is additionally shown, but lid 123 and shield 124 are not shown.

FIG. 24 is an elevation view of components of the second embodiment; shown are frame 120 in partial section, rod 162, and pawl 160 in locked position; chain 57 is additionally shown.

FIG. 25 is an elevation view of the first embodiment with pawl 160 in an intermediate position; chain 57 is additionally shown, but lid 103 and shield 104 are not shown.

FIG. 26 is an elevation view of components of the first embodiment; shown are frame 100 in partial section, rod 162, and pawl 160 in an intermediate position; chain 57 is additionally shown.

FIG. 27 is an elevation view of the second embodiment with pawl 160 in an intermediate position; chain 57 is additionally shown, but lid 123 and shield 124 are not shown.

FIG. 28 is an elevation view of components of the second embodiment; shown are frame 120 in partial section, rod 162, and pawl 160 in an intermediate position; chain 57 is additionally shown.

DRAWINGS—LIST OF REFERENCE NUMERALS

Components in Environment of Invention

| | | | |
|---|---|---|---|
| 50 | boat | 51 | bridge |
| 52 | bow area | 53 | foredeck |
| 54 | hull | 55 | pulpit |
| 56 | anchor | 57 | chain |
| 58 | windlass | 59 | locker |
| 60 | bulkhead | 61 | battery |

Prior-Art Components Superseded by Invention

| | | | |
|---|---|---|---|
| 80 | chain stopper | 81 | safety cable |
| 82 | shackle | | |

Embodiments of Invention

| | | | |
|---|---|---|---|
| 90 | first embodiment | 91 | second embodiment |

Components Tailored for First Embodiment

| | | | |
|---|---|---|---|
| 100 | frame | 101 | housing |
| 102 | gasket | 103 | lid |
| 104 | shield | 105 | chain guide |
| 106 | rod-support hole | 107 | rod-support recess |
| 108 | brace | 109 | paddle mount |
| 110 | ferrule | 111 | fixed pin |
| 112 | weephole | 113 | chamber |
| 114 | niche | 115 | cable assembly |
| 116 | cable egress | 117 | wire egress |

Components Tailored for Second Embodiment

| | | | |
|---|---|---|---|
| 136 | cable egress | 137 | wire egress |

Components Specific to First Embodiment

| | | | |
|---|---|---|---|
| 140 | rod passage | 141 | sheave |
| 142 | sheave mount | 143 | sheave guard |

Components Specific to Second Embodiment

| | | | |
|---|---|---|---|
| 150 | cable duct | 151 | cable ingress |
| 152 | cable jacket | | |

Components Common to Both Embodiments

| | | | |
|---|---|---|---|
| 160 | pawl | 161 | lumen |
| 162 | rod | 163 | rotating pin |
| 164 | tension spring | 165 | bellows |
| 166 | cable | 167 | solenoid |
| 168 | plunger | 169 | compression spring |
| 170 | connecting pin | 171 | ball stops |

-continued

| | | | |
|---|---|---|---|
| 172 | paddle | 173 | switch mount |
| 174 | slot | 175 | lock contact switch |
| 176 | unlock contact switch | 177 | activation switch |
| 178 | lock switch input wire | 179 | lock switch output wire |
| 180 | unlock switch input wire | 181 | unlock switch output wire |
| 182 | solenoid power wire | 183 | solenoid return wire |
| 184 | lock LED | 185 | unlock LED |
| 186 | lock resistor | 187 | unlock resistor |
| 188 | fuse | 189 | auxiliary control set |
| 190 | microcontroller | 191 | power transistor |

Flowchart Steps

200-392

DETAILED DESCRIPTION

Figure 1:
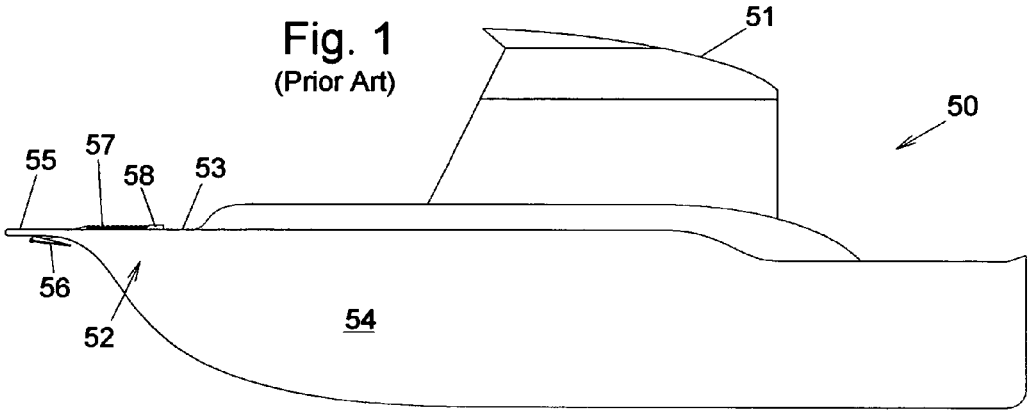
Fig. 1 (Prior Art)
FIG. 1 is an elevation view of a typical medium-sized boat.
Figure 2:
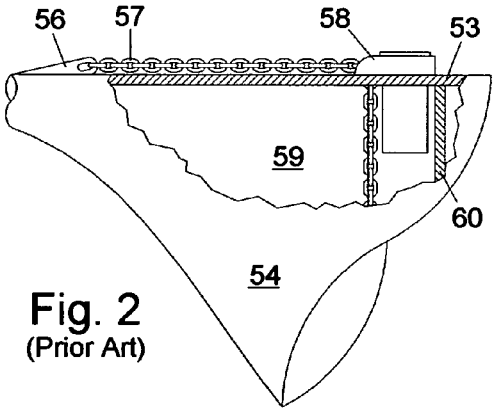
Fig. 2 (Prior Art)
FIG. 2 is a partial-sectional elevation view of the bow area of the boat illustrated in FIG. 1.
Figure 3:
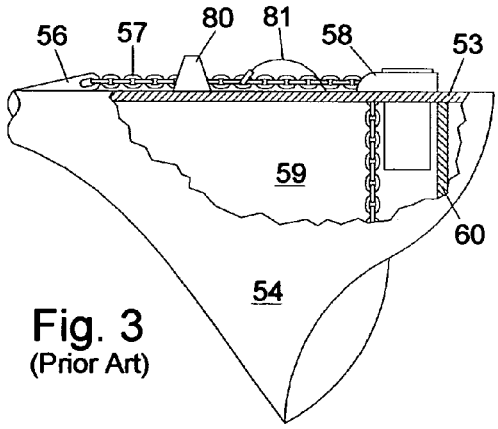
Fig. 3 (Prior Art)
FIG. 3 is a partial-sectional elevation view of the bow area illustrated in FIG. 2, additionally showing an installation of prior-art mechanisms for securing an anchor chain.
Figure 4:
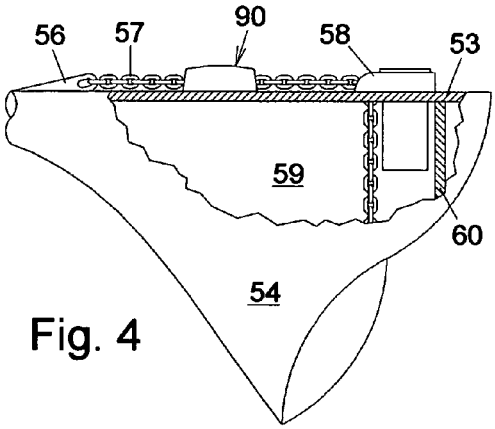
FIG. 4 is a partial-sectional elevation view of the bow area illustrated in FIG. 2, additionally showing an installation of a first embodiment of the invention.
Figure 5:
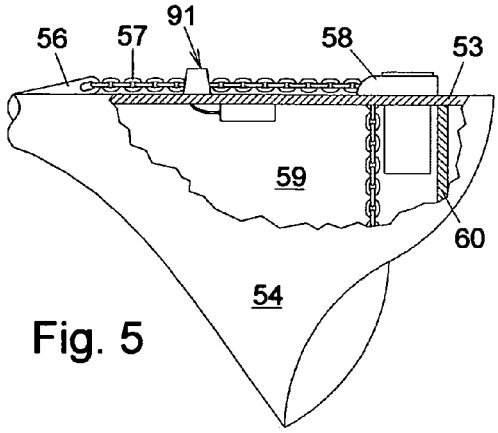
FIG. 5 is a partial-sectional elevation view of the bow area illustrated in FIG. 2, additionally showing an installation of a second embodiment of the invention.

The present invention can be embodied in many forms. A key distinction among various embodiments is whether their designs are physically monolithic or physically separable. FIG. 4 is a partial-sectional side elevation view of bow area 52, wherein the anchoring system is augmented by a first embodiment 90, with physically monolithic design. FIG. 5 is a partial-sectional side elevation view of bow area 52, wherein the anchoring system is augmented by a second embodiment 91, with physically separable design. Because first embodiment 90 can be mounted as a single unit, it is simpler to install on watercraft. However, because second embodiment 91 features separable components, it can be installed on watercraft with less available foredeck area.

1. FIRST EMBODIMENT

Components

Figure 6:
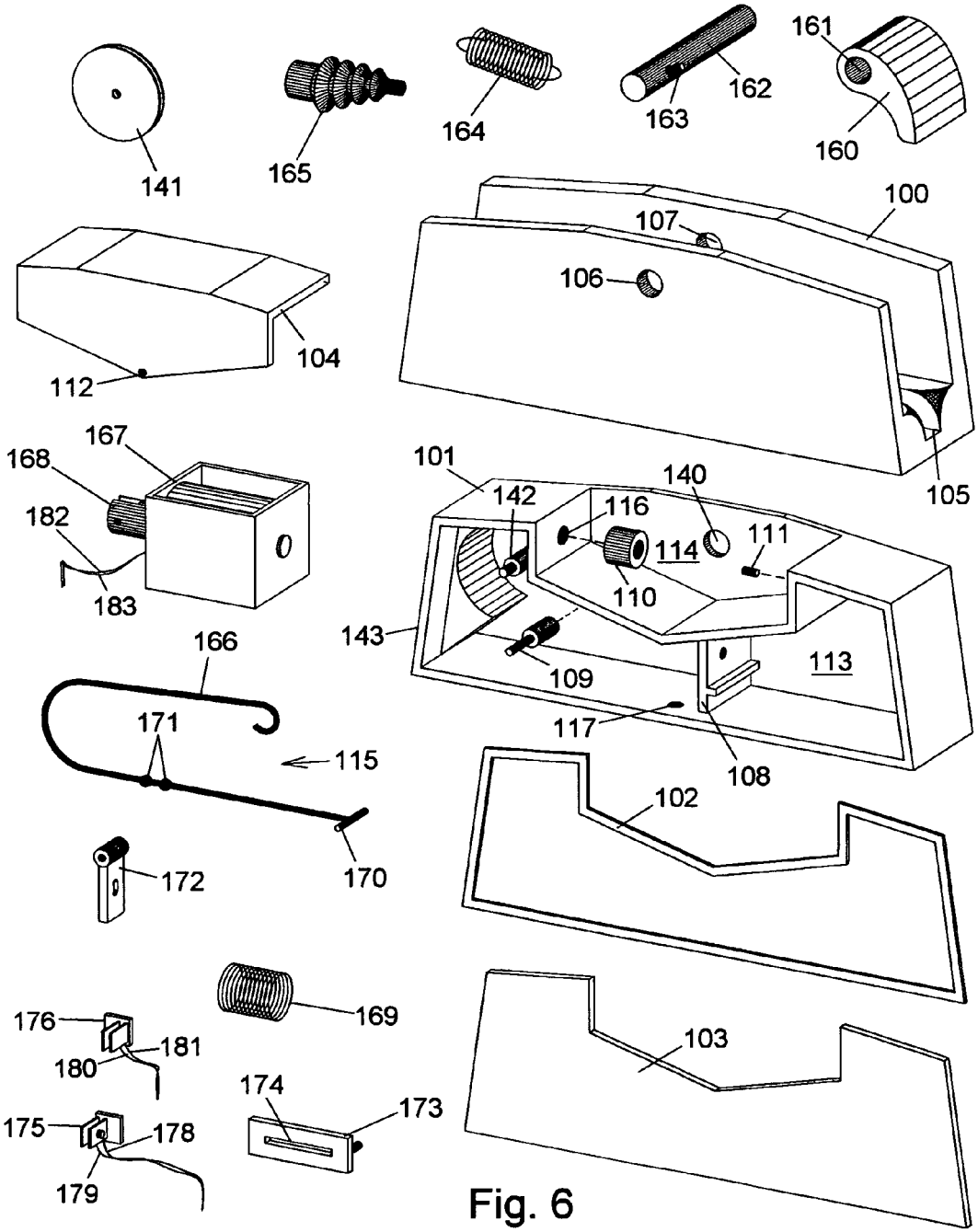
FIG. 6 is a perspective view of unassembled components in the first embodiment of the invention.

FIG. 6 is a perspective general view illustrating components of first embodiment 90. The two largest components of first embodiment 90 are a frame 100 and a housing 101. Frame 100 preferably includes a molded-in chain guide 105. Frame 100 also includes a rod-support hole 106 and a rod-support recess 107.

Housing 101 includes several internally mounted subcomponents, including a brace 108, a paddle mount 109, a sheave mount 142, and a sheave guard 143. Housing 101 also includes several externally mounted subcomponents, including a ferrule 110 and a fixed pin 111. Additionally, housing 101 includes several apertures, including a cable egress 116, a wire egress 117, and a rod passage 140. Walls of housing 101 form a chamber 113 and a niche 114. In FIG. 6, paddle mount 109, ferrule 110, and fixed pin 111 are shown exploded from housing 101 for clarity of illustration. In particular, ferrule 110 is adjacent to and concentric with cable egress 116.

Continuing downward in the figure, FIG. 6 illustrates a gasket 102 and a lid 103. As explained below, gasket 102 and lid 103 can be fitted onto housing 101 to impede entry of water into chamber 113.

Returning to the top of the figure, FIG. 6 illustrates, from left to right, a sheave 141, bellows 165, a tension spring 164, a rod 162 which includes a rotating pin 163, and a pawl 160 which includes a lumen 161. As explained below, rod 162 can be inserted through lumen 161 and mechanically affixed to pawl 160.

The remaining components shown in FIG. 6 are itemized from top to bottom: A shield 104 includes a weep hole 112;

as explained below, shield 104 can be fitted onto housing 101 so as to enclose niche 114. A solenoid 167 includes a plunger 168, a solenoid power wire 182 and a solenoid-return wire 183. A cable assembly 115 comprises a cable 166, a connecting pin 170, and ball stops 171. FIG. 6 further shows a paddle 172 and a compression spring 169. An unlock contact switch 176 is a normally open, momentary switch, connected to an unlock switch input wire 180 and an unlock switch output wire 181. A lock contact switch 175 is a normally open, momentary switch, connected to a lock switch input wire 178 and a lock switch output wire 179. A Switch mount 173 includes a slot 174.

2. FIRST EMBODIMENT

Assembly

Figure 7:
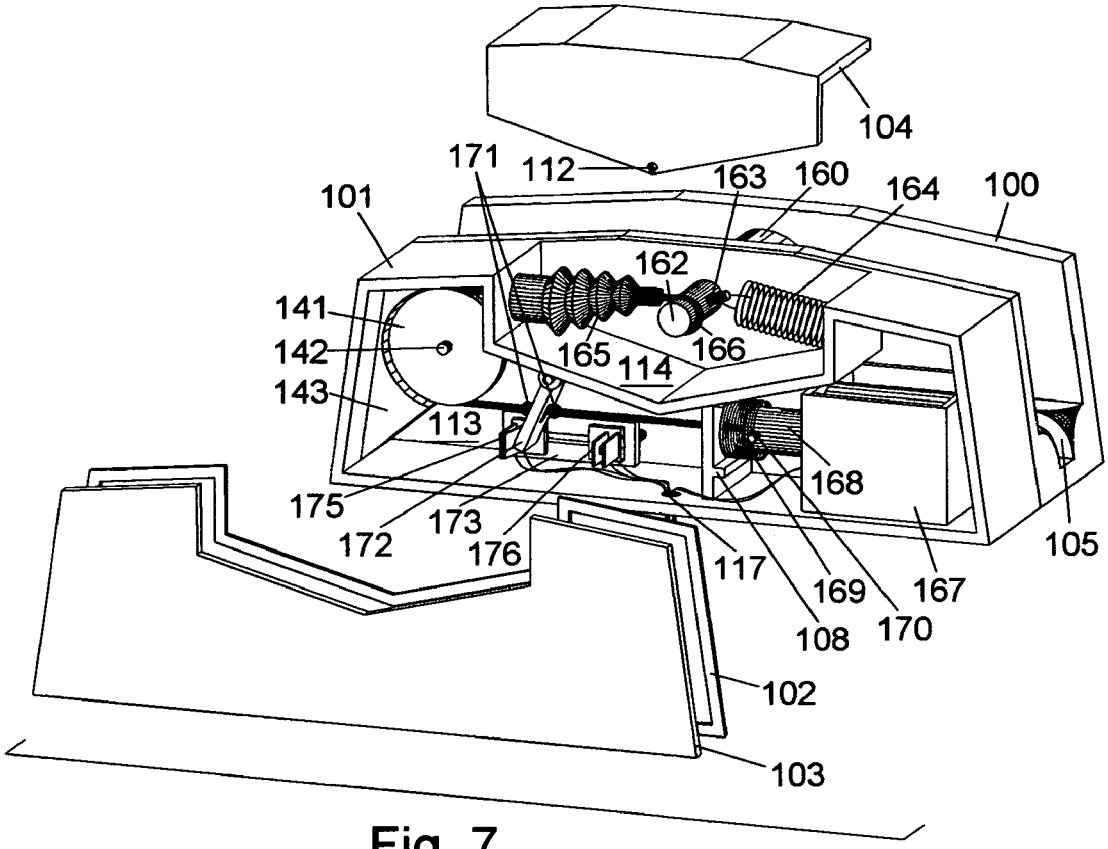
FIG. 7 is a perspective view of the first embodiment, in which lid 103 and gasket 102 are pulled away and shield 104 is raised to expose internal workings of the invention.

FIG. 7 is a perspective general view of first embodiment 90, shown with lid 103 and gasket 102 pulled away and shield 104 raised to reveal how components are internally arranged.

Frame 100 and housing 101 are placed adjacent to each other, such that rod-support hole 106 is concentric with rod passage 140. Preferably, frame 100 and housing 101 are made fast to each other; however, alternate securing arrangements are possible. For example, frame 100 and housing 101 could be independently fastened to the foredeck in adjacent locations, or frame 100 and housing 101 could be fabricated as a single component.

Pawl 160 is placed inside frame 100 such that lumen 161 is concentric with rod-support hole 106 and rod-support recess 107. Rod 162 is slid through rod passage 140, rod-support hole 106, lumen 161 of pawl 160, and rod-support recess 107, such that the part of rod 162 containing rotating pin 163 is inside niche 114. Rod 162 is made fast to pawl 160, such that if either component rotates, the other component will rotate with it.

One end of tension spring 164 is connected to rotating pin 163, and the opposite end of tension spring 164 is connected to fixed pin 111. Tensile force of tension spring 164 urges rod 162 to rotate, which in turn urges pawl 160 to rotate its free end toward chain guide 105. Alternately, rotational force could be applied to rod 162 by a spring other than a tension spring, such as a compression spring or a torsion spring. Furthermore, rotational force could be applied by a form of elastic actuator other than a spring, such as a shock cord, an elastic band, a piston mounted in a pressurized cylinder, an energized solenoid, or other such device.

One end of cable 166 is partly wound around rod 162 and then connected thereto. This winding is such that tensile force on cable 166 urges rod 162 to rotate in a direction counter to that urged by tension spring 164.

The larger end of bellows 165 is attached to ferrule 110. Cable 166 passes through bellows 165, ferrule 110, and cable egress 116. The smaller end of bellows 165 is secured to cable 166.

Sheave 141 is rotatably mounted on sheave mount 142 of housing 101. Cable 166 passes between sheave 141 and sheave guard 143 of housing 101, thereby turning cable 166 around by approximately 180 degrees. Preferably, sheave 141, sheave mount 142, and sheave guard 143 are configured such that the gap between sheave guard 143 and the outer rim of sheave 141 is too small to admit cable 166, thereby preventing cable 166 from slipping off sheave 141 even if cable 166 is slackened.

Paddle 172 is pivotably mounted on paddle mount 109 of housing 101. Cable 166 passes through a hole in paddle 172. Ball stops 171 are secured to cable 166 on both sides of paddle 172, such that longitudinal movement of cable 166 causes paddle 172 to pivot.

Solenoid 167 is mounted inside chamber 113, on the opposite side of brace 108 from that on which sheave 141 and paddle 172 are mounted. Compression spring 169 is suspended between brace 108 and plunger 168 of solenoid 167. Cable 166 passes through a hole in brace 108, through compression spring 169, and to plunger 168. Connecting pin 170 connects cable 166 to plunger 168. Connecting pin 170 also connects to one end of compression spring 169, and the opposite end of compression spring 169 rests against brace 108.

Switch mount 173 is mounted inside chamber 113 in the manner shown in FIG. 7. Lock contact switch 175 and unlock contact switch 176 are mounted to switch mount 173, such that they can be affixed at any position along slot 174 of switch mount 173. Fixed locations for lock contact switch 175 and unlock contact switch 176 are established as described below in the section on calibration.

Wires 178, 179, 180, 181, 182, and 183 are routed out of chamber 113 through wire egress 117. Preferably, wire egress 117 is sealed using a marine-grade sealant such as silicone.

Figure 8:
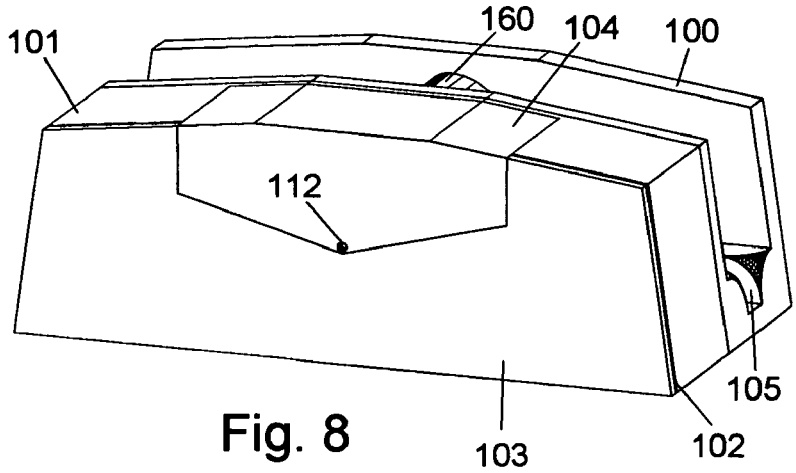
FIG. 8 is a perspective view of the first embodiment, fully assembled as shown in the installation of FIG. 4.

Assembly is completed by attaching gasket 102, lid 103, and shield 104 to housing 101, as shown in FIG. 8, which is a perspective general view of first embodiment 90. When gasket 102 and lid 103 are firmly attached to housing 101, when bellows 165 are attached to ferrule 110 and to cable 166, and when wire egress 117 is sealed, chamber 113 is made watertight. When shield 104 is attached to housing 101, tension spring 164 and bellows 165 are protected from various damaging influences, such as ultraviolet radiation and physical contact.

Optionally, components for position indication may be omitted from this embodiment. Such components include paddle 172, paddle mount 109, ball stops 171, switch mount 173, lock contact switch 175, unlock contact switch 176, and wires 178, 179, 180, and 181. The invention is still useful without position indication; however, it may be more difficult to effect precise control without the information provided to the operator by the position indication components.

First embodiment 90 is installed on foredeck 53 as shown in FIG. 4, with further reference to FIG. 8. Frame 100 is secured atop foredeck 53, and housing 101 is secured adjacent to frame 100. Chain 57 is fed from windlass 58, passed through frame 100 beneath pawl 160, and attached to anchor 56.

3. SECOND EMBODIMENT

Components

Figure 9:
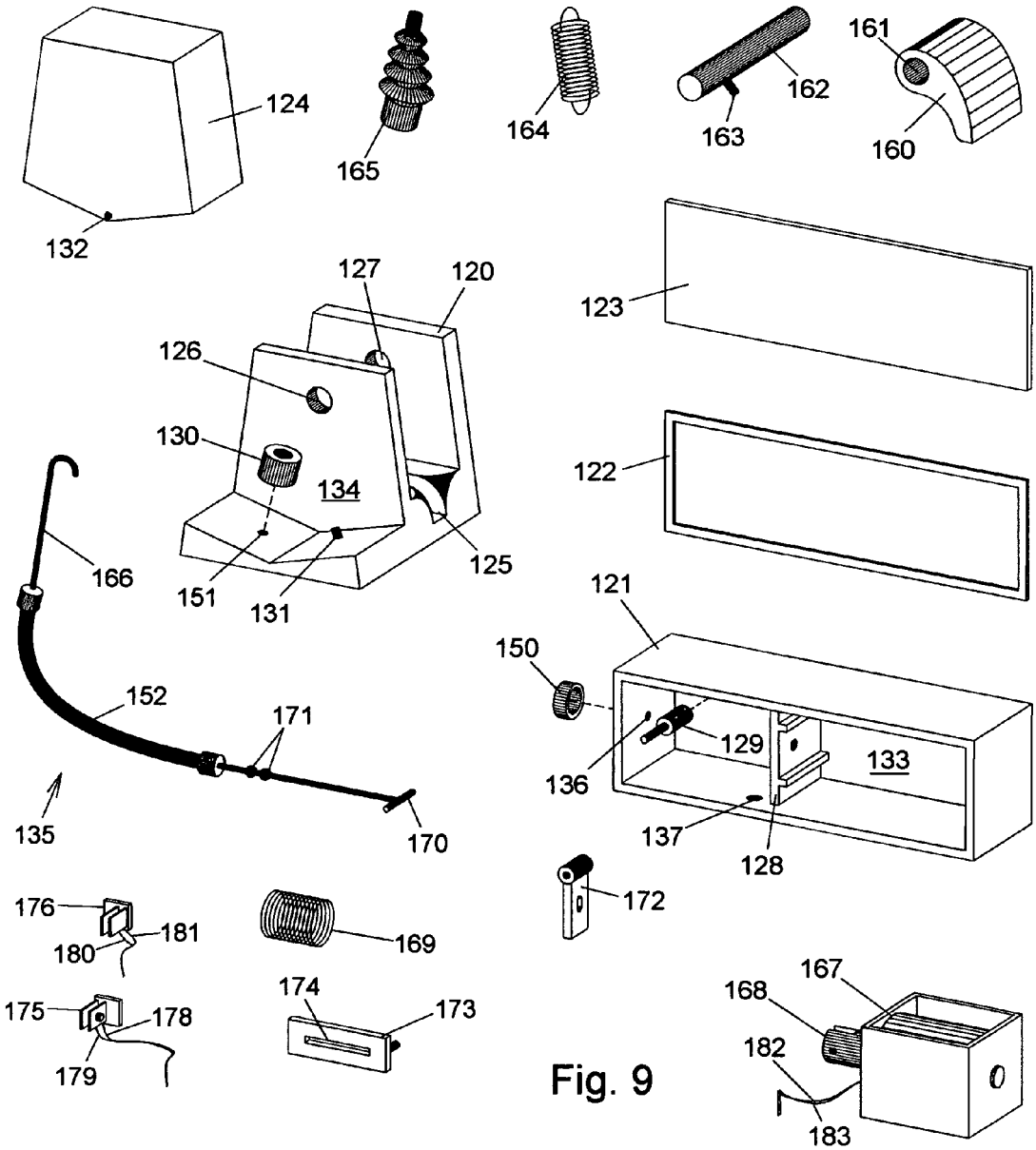
FIG. 9 is a perspective view of unassembled components in the second embodiment of the invention.

FIG. 9 is a perspective general view illustrating components of second embodiment 91. The two largest components of second embodiment 91 are a frame 120 and a housing 121. Frame 120 preferably includes a molded-in chain guide 125. Frame 120 also includes a rod-support hole 126, a rod-support recess 127, and a cable ingress 151. Additionally, frame 120 includes a ferrule 130 and a fixed pin 131. Walls of frame 120 form a niche 134. In FIG. 9, ferrule 130 is shown exploded from frame 120 for clarity of illustration. In particular, ferrule 130 is adjacent to and concentric with cable ingress 151.

Housing 121 includes several internally mounted subcomponents, including a brace 128 and a paddle mount 129. Housing 121 also includes an externally mounted cable duct 150. Additionally, housing 121 includes several apertures, including a cable egress 136 and a wire egress 137. Walls of housing 121 form a chamber 133. In FIG. 9, paddle mount 129 and cable duct 150 are shown exploded from housing 121 for clarity of illustration. In particular, cable duct 150 is adjacent to and concentric with cable egress 136.

Above housing 121, FIG. 9 illustrates a gasket 122 and a lid 123. As explained below, gasket 122 and lid 123 can be fitted onto housing 101 to impede entry of water into chamber 133.

At the upper left, FIG. 9 illustrates a shield 124, which includes a weep hole 132; as explained below, shield 124 can be fitted onto frame 120 so as to enclose niche 134. Continuing to the right, FIG. 9 illustrates several components which are in common with first embodiment 90, namely bellows 165, tension spring 164, rod 162 including rotating pin 163, and pawl 160 including lumen 161.

Below frame 120, FIG. 9 illustrates a cable assembly 135. As in cable assembly 115 of the first embodiment, cable assembly 135 includes cable 166, connecting pin 170, and ball stops 171. Cable assembly 135 additionally comprises cable jacket 152.

The remaining components shown in FIG. 9 are in common with first embodiment 90. They are itemized from left to right, sub-ordered from top to bottom: Unlock contact switch 176 is connected to unlock switch input wire 180 and unlock switch output wire 181. Lock contact switch 175 is connected to lock switch input wire 178 and lock switch output wire 179. Next are compression spring 169, switch mount 173 including slot 174, and paddle 172. Solenoid 167 includes plunger 168, solenoid power wire 182 and solenoid-return wire 183.

4. SECOND EMBODIMENT

Assembly

Figure 10:
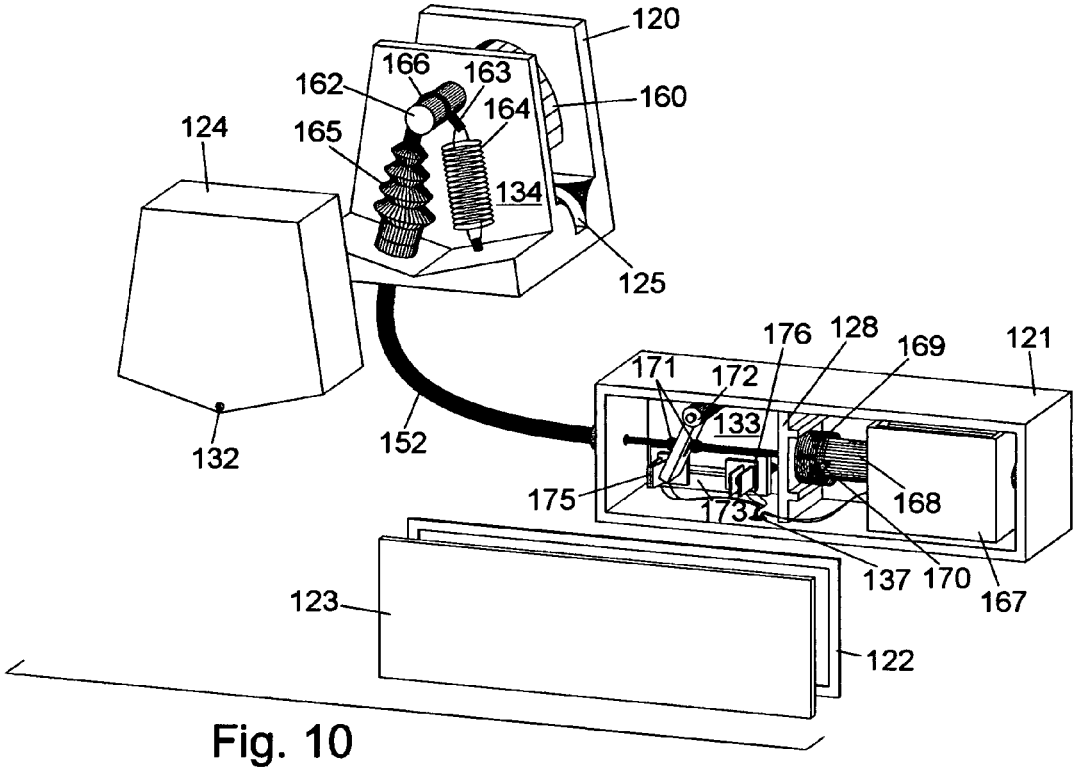
FIG. 10 is a perspective view of the second embodiment, in which lid 123, gasket 122, and shield 124 are pulled away to expose internal workings of the invention.

FIG. 10 is a perspective general view of second embodiment 91, shown with lid 123, gasket 122, and shield 124 pulled away to reveal how components are internally arranged.

Pawl 160 is placed inside frame 120 such that lumen 161 is concentric with rod-support hole 126 and rod-support recess 127. Rod 162 is slid through rod-support hole 126, lumen 161 of pawl 160, and rod-support recess 127, such that the part of rod 162 containing rotating pin 163 is inside niche 134. Rod 162 is made fast to pawl 160, such that if either component rotates, the other component will rotate with it.

One end of tension spring 164 is connected to rotating pin 163, and the opposite end of tension spring 164 is connected to fixed pin 131. Tensile force of tension spring 164 urges rod 162 to rotate, which in turn urges pawl 160 to rotate its free end toward chain guide 125. Alternately, rotational force could be applied to rod 162 by a spring other than a tension spring, such as a compression spring or a torsion spring. Furthermore, rotational force could be applied by a form of elastic actuator other than a spring, such as a shock cord, an elastic band, a piston mounted in a pressurized cylinder, an energized solenoid, or other such device.

One end of cable 166 is partly wound around rod 162 and then connected thereto. This winding is such that tensile force on cable 166 urges rod 162 to rotate in a direction counter to that urged by tension spring 164.

The larger end of bellows 165 is attached to ferrule 130. One end of cable jacket 152 is connected to the underside of frame 120, adjacent to cable ingress 151. The other end of cable jacket 152 is connected to cable duct 150 of housing 121. In practice, before completing these attachments, cable jacket 152 is preferably fed through a hole in foredeck 53, as shown in FIG. 5 and described more fully below. Cable 166 passes through bellows 165, ferrule 130, cable ingress 151, cable jacket 152, cable duct 150, and cable egress 136. The smaller end of bellows 165 is secured to cable 166.

Paddle 172 is pivotably mounted on paddle mount 129 of housing 121. Cable 166 passes through a hole in paddle 172. Ball stops 171 are secured to cable 166 on both sides of paddle 172, such that longitudinal movement of cable 166 causes paddle 172 to pivot.

Solenoid 167 is mounted inside chamber 133, on the opposite side of brace 128 from that on which sheave 141 and paddle 172 are mounted. Compression spring 169 is suspended between brace 128 and plunger 168 of solenoid 167. Cable 166 passes through a hole in brace 128, through compression spring 169, and to plunger 168. Connecting pin 170 connects cable 166 to plunger 168. Connecting pin 170 also connects to one end of compression spring 169, and the opposite end of compression spring 169 rests against brace 128.

Switch mount 173 is mounted inside chamber 133 in the manner shown in FIG. 10. Lock contact switch 175 and unlock contact switch 176 are mounted to switch mount 173, such that they can be affixed at any position along slot 174 of switch mount 173. Fixed locations for lock contact switch 175 and unlock contact switch 176 are established as described below in the section on calibration.

Wires 178, 179, 180, 181, 182, and 183 are routed out of chamber 133 through wire egress 137. Preferably, wire egress 137 is sealed using a marine-grade sealant such as silicone.

Figure 11:
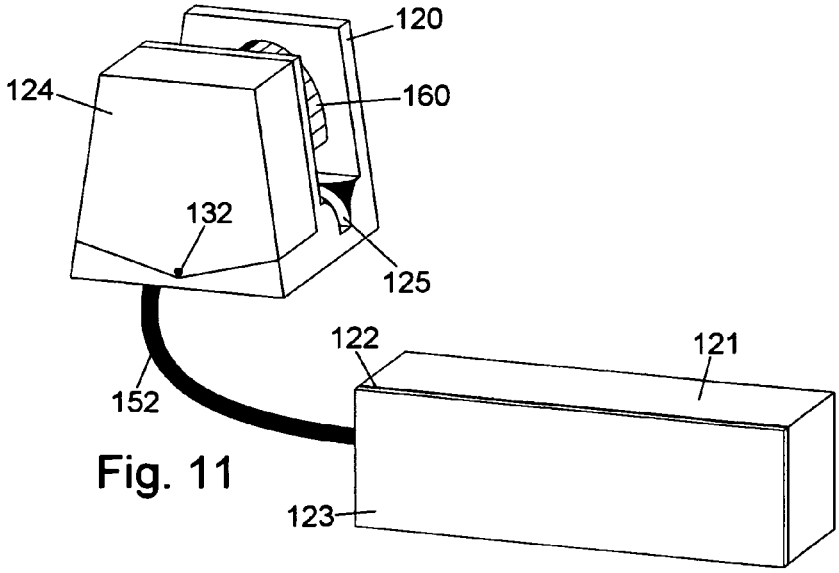
FIG. 11 is a perspective view of the second embodiment, fully assembled as shown in the installation of FIG. 5.

Assembly is completed by attaching gasket 122 and lid 123 to housing 121, and by attaching shield 124 to frame 120, as shown in FIG. 11, which is a perspective general view of second embodiment 91. When gasket 122 and lid 123 are firmly attached to housing 121, when bellows 165 are attached to ferrule 130 and to cable 166, and when wire egress 137 is sealed, chamber 133 is made watertight. When shield 124 is attached to frame 120, tension spring 164 and bellows 165 are protected from various damaging influences, such as ultraviolet radiation and physical contact.

Optionally, components for position indication may be omitted from this embodiment. Such components include paddle 172, paddle mount 109, ball stops 171, switch mount 173, lock contact switch 175, unlock contact switch 176, and wires 178, 179, 180, and 181. The invention is still useful without position indication; however, it may be more difficult to effect precise control without the information provided to the operator by the position indication components.

Second embodiment 91 is installed on foredeck 53 as shown in FIG. 5, with further reference to FIG. 11. Frame 120 is secured atop foredeck 53. Housing 121 is preferably secured at a location physically separated from frame 120, such as below foredeck 53 inside locker 59, as shown in FIG. 5. If frame 120 and housing 121 are separated by a barrier, such as foredeck 53 as shown in FIG. 5, cable jacket 153 is routed through a hole in this barrier during assembly, as described above. Chain 57 is fed from windlass 58, passed through frame 120 beneath pawl 160, and attached to anchor 56.

5. EMBODIMENTS

Wiring

FIG. 12 is a schematic circuit diagram illustrating one manner in which the above-described embodiments could be wired for use. According to the figure, a positive pole of a battery 61 is connected through a fuse 188 to an activation switch 177, which is a normally open switch. Activation switch 177 is connected to solenoid power wire 182, and solenoid-return wire 183 is connected to a negative pole of battery 61, such that closing activation switch 177 engages solenoid 167.

Fuse 188 is connected to lock switch input wire 178, and lock switch output wire 179 is connected to a lock resistor 186, which is connected to a lock LED 184, which is connected to the negative pole of battery 61. Thus, closing lock contact switch 175 illuminates lock LED 184. In like manner, fuse 188 is connected to unlock switch input wire 180, and unlock switch output wire 118 is connected to an unlock resistor 187, which is connected to an unlock LED 185, which is connected to the negative pole of battery 61. Thus, closing unlock contact switch 176 illuminates unlock LED 185.

Preferably, activation switch 177, lock LED 184, and unlock LED 185 are located in bridge 51 nearby controls for windlass 58. Alternately, this switch and LEDs may be located in other areas of boat 50 from which anchor-chain control is desired.

FIG. 13 is schematic circuit diagram illustrating a second manner in which the above-described embodiments could be wired for use. FIG. 13 is substantially similar to FIG. 12 except that the circuit shown in FIG. 13 includes an auxiliary control set 189. In particular, FIG. 13 shows has two activation switches 177*a* and 177*b* in lieu of one activation switch 177, two lock resistors 186*a* and 186*b* and two lock LEDs 184*a* and 184*b* in lieu of one lock resistor 186 and one lock LED 184, and two unlock resistors 187*a* and 187*b* and two unlock LEDs 185*a* and 185*b* in lieu of one unlock resistor 187 and one unlock LED 185. This circuit allows anchor-chain control from two locations on boat 50. More generally, the present invention could be wired with multiple auxiliary control sets, thereby providing anchor-chain control from multiple locations on boat 50.

Figure 14:
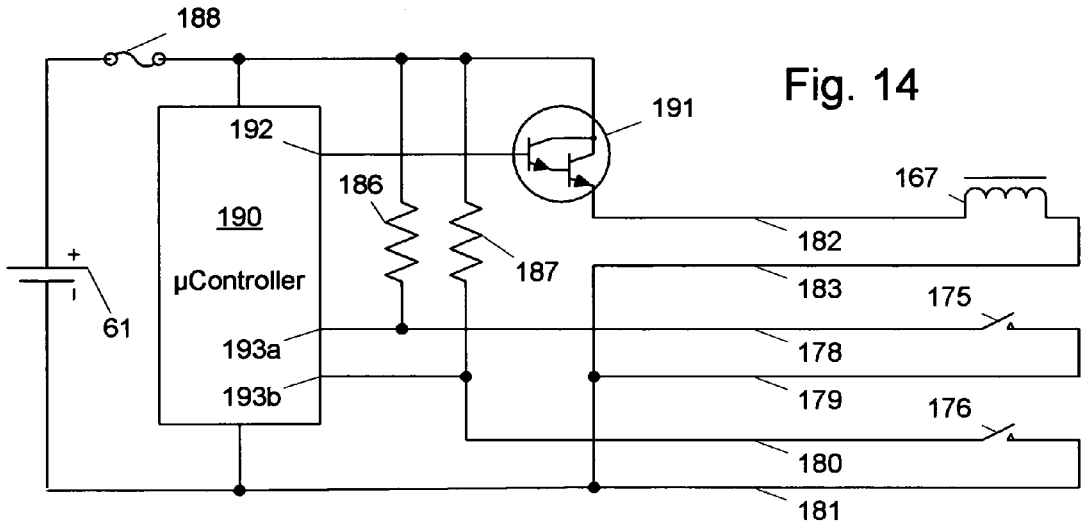
FIG. 14 is a schematic circuit diagram showing electrical connections in embodiments of the invention involving a microcontroller.

FIG. 14 is a schematic circuit diagram illustrating a third manner in which the above-described embodiments could be wired for use. The circuit of this figure includes a microcontroller 190 and a power transistor 191. Microcontroller 190 could be a single-chip processor, a processor chip set, a collection of discrete logic gates, or any other arrangement of electronic components that can be programmed to carry out operational steps involved in controlling an embodiment of the present invention. FIG. 13 illustrates power transistor 191 as a Darlington pair; however, alternate forms of electrically actuated switch could be used instead, including a single transistor, a solid-state switch, a relay, or other such device.

According to FIG. 14, microcontroller 190 and power transistor 191 receive power from battery 61 through fuse 188. Power transistor 191 is connected to an output port 192 of microcontroller 190, power transistor 191 is connected to solenoid power wire 182, and solenoid-return wire 183 is connected to the negative pole of battery 61, such that by energizing output port 192, microcontroller 191 engages solenoid 167.

Fuse 188 is connected to lock resistor 186, which is in turn connected to lock switch input wire 178 and to an input port 193*a* of microcontroller 190. Lock switch output wire 179 is connected to the negative pole of battery 61. Thus, when microcontroller 190 samples input port 193*a* while lock contact switch 175 is open, microcontroller 190 samples a high-valued signal; and when microcontroller 190 samples input port 193*a* while lock contact switch 175 is closed, microcontroller 190 samples a low-valued signal.

In like manner, fuse 188 is connected to unlock resistor 187, which is in turn connected to unlock switch input wire 180 and to an input port 193*b* of microcontroller 190. Unlock switch output wire 181 is connected to the negative pole of battery 61. Thus, when microcontroller 190 samples input port 193*b* while unlock contact switch 176 is open, microcontroller 190 samples a high-valued signal; and when microcontroller 190 samples input port 193*b* while unlock contact switch 176 is closed, microcontroller 190 samples a low-valued signal.

Preferably, microcontroller 191 has a control-and-display interface located in bridge 51 nearby controls for windlass 58. Alternately, this control-and-display interface may be located in other areas of boat 50 from which anchor-chain control is desired. Microcontroller 191 may be located on bridge 51, in locker 59, or anywhere else on boat 50 where it is reasonably protected. If windlass 58 has means for electronic control, microcontroller 191 may be used to control both windlass 58 and an embodiment of the present invention.

Other wiring arrangements are also possible, including but not limited to arrangements involving multiple microcontrollers or combinations of one or more manual control sets with one or more microcontrollers. Some control stations may omit one or more components from the set consisting of activation switch 177, lock LED 184, and unlock LED 185. Additionally, wiring connections to one or both of switches 175 and 176 may be omitted for some or all control stations. If no wiring connections are made to either switch, the switches themselves may be omitted, as may all associated components, including switch mount 173, ball stops 171, paddle 172, and paddle mount 109 or 129.

6. EMBODIMENTS

Calibration

Lock contact switch 175 and unlock contact switch 176 are intended to register particular positions of pawl 160. For these switches to register the positions accurately, embodiments of the present invention may require calibration. First embodiment 90 may be calibrated prior to installation; however, second embodiment 91 may require installation before it can be calibrated.

Figure 15:
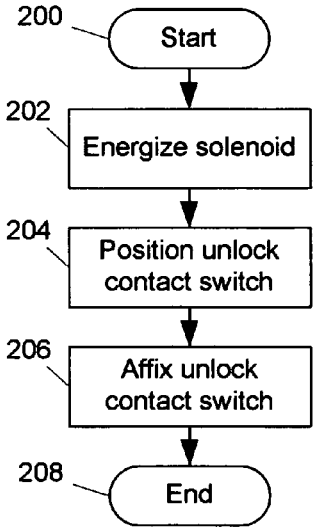
FIG. 15 is a flow diagram showing preferred steps performed in calibrating a position for unlock contact switch 176 in accordance with embodiments of the invention.

FIG. 15 is a flow diagram illustrating preferred steps in the calibration of unlock contact switch 176. This flow diagram can be understood with reference to the illustration of the embodiments shown in FIGS. 7 and 10. The calibration procedure begins at step 200. Step 202 energizes solenoid 167, which retracts plunger 168, thereby pulling paddle 172 toward brace 108 or 128. In step 204, unlock contact switch 176 is positioned on switch mount 173 such the switch is held closed by paddle 172. In step 206, unlock contact switch 176 is affixed in the location established in step 204. The calibration procedure then ends at step 208.

Figure 16:
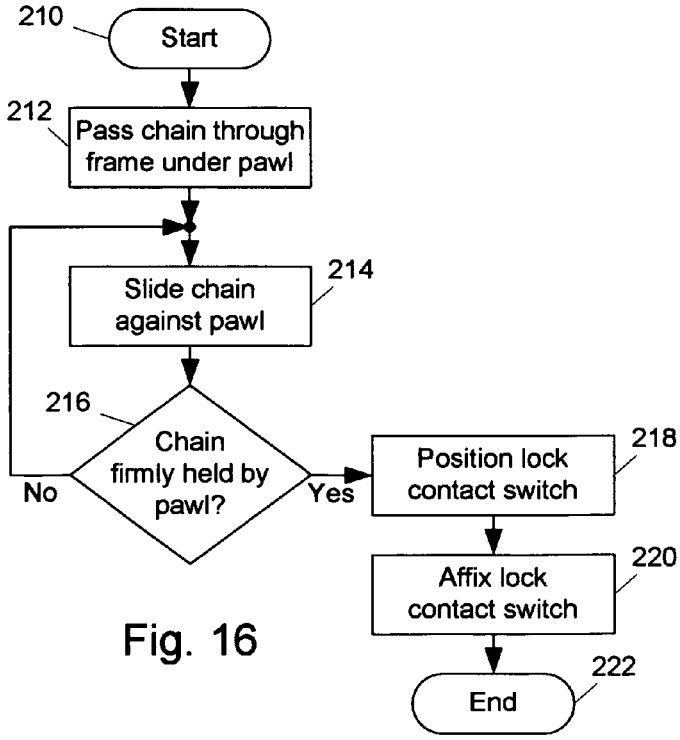
FIG. 16 is a flow diagram showing preferred steps performed in calibrating a position for lock contact switch 175 in accordance with embodiments of the invention.

FIG. 16 is a flow diagram illustrating preferred steps in the calibration of lock contact switch 175. This flow diagram can be understood with reference to the illustration of the embodiments shown in FIGS. 7 and 10. The calibration procedure begins at step 210. In step 212, chain 57 is passed through frame 100 or 120, beneath pawl 160. Note that solenoid 167 is not energized. In step 214, chain 57 is slid longitudinally along chain guide 105 or 125 against the direction permitted by pawl 160, thereby pulling paddle 172 away from brace 108 or 128. In step 216, if chain 57 is not held firmly by pawl 160, step 214 is re-executed, sliding chain 57 further along chain guide 105 or 125. This process continues until chain 57 is held firmly by pawl 160. Then, in step 218, lock contact switch 175 is positioned on switch mount 173 such the switch is held closed by paddle 172. In step 220, lock contact switch 175 is affixed in the location established in step 218. The calibration procedure then ends at step 222.

7. EMBODIMENTS

Theory of Operation

Operating principles of the present invention may be best understood by considering four distinct positions of pawl 160. With regard to first embodiment 90, these positions are illustrated in FIGS. 17, 18, 21, 22, 25, 26, 29, and 30. With regard to second embodiment 91, these positions are illustrated in FIGS. 19, 20, 23, 24, 27, 28, 31, and 32.

FIGS. 17-20 are elevation views illustrating embodiments of the invention in which pawl 160 is in unlocked position. FIGS. 17 and 18 show the first embodiment. In particular, FIG. 17 shows this embodiment without lid 103 and shield 104; and FIG. 18 shows frame 100 in partial section, rod 162, and pawl 160. FIGS. 19 and 20 show the second embodiment. In particular, FIG. 19 shows this embodiment without lid 123 and shield 124; and FIG. 20 shows frame 120 in partial section, rod 162, and pawl 160.

When pawl 160 is in unlocked position, chain 57 is free to move longitudinally in either direction. Thus, when windlass 58 pays out chain 57, chain 57 may move longitudinally away from windlass 58. Alternatively, when windlass 58 retracts chain 57, chain 57 may move longitudinally toward windlass 58. In this position, unlock contact switch 176 is closed. Pawl 160 is in unlocked position only when solenoid 167 is energized. Furthermore, pawl 160 may be prevented from moving to unlocked position if it is held by force on chain 57 from anchor 56, as shown in FIGS. 21-24.

FIGS. 21-24 are elevation views illustrating embodiments of the invention in which pawl 160 is in locked position. FIGS. 21 and 22 show the first embodiment. In particular, FIG. 21 shows this embodiment without lid 103 and shield 104; and FIG. 22 shows frame 100 in partial section, rod 162, and pawl 160. FIGS. 23 and 24 show the second embodiment. In particular, FIG. 23 shows this embodiment without lid 123 and shield 124; and FIG. 24 shows frame 120 in partial section, rod 162, and pawl 160.

When pawl 160 is in locked position, chain 57 is prevented from moving longitudinally away from windlass 58; however, chain 57 is still free to move toward windlass 58 when windlass 58 applies a force on chain 57 that is sufficient to overcome the force on pawl 160 from tension spring 164. In this position, lock contact switch 175 is closed. Pawl 160 is in locked position only when it is held by force on chain 57 from anchor 56. Pawl 160 may be in locked position irrespective of whether solenoid 167 is energized.

FIGS. 25-28 are elevation views illustrating embodiments of the invention in which pawl 160 is in an intermediate position. FIGS. 25 and 26 show the first embodiment. In particular, FIG. 25 shows this embodiment without lid 103 and shield 104; and FIG. 26 shows frame 100 in partial section, rod 162, and pawl 160. FIGS. 27 and 28 show the second embodiment. In particular, FIG. 27 shows this embodiment without lid 123 and shield 124; and FIG. 28 shows frame 120 in partial section, rod 162, and pawl 160.

When pawl 160 is in an intermediate position, chain 57 is free to move longitudinally toward windlass 58. Chain 57 is also free to move away from windlass 58, but only for a short distance, because as chain 57 moves away from windlass 58, pawl 160 rotates into a gap between two vertical links and thence catches against one of the vertical links. Then, as chain 57 continues to move longitudinally, pawl 160 rotates into locked position, as shown in FIGS. 21-24. In intermediate positions, neither lock contact switch 175 nor unlock contact switch 176 is closed. Pawl 160 is in an intermediate position only when solenoid 167 is not energized. If solenoid 167 is energized when pawl 160 is in an intermediate position, pawl 160 rotates into unlocked position, as shown in FIGS. 17-20.

Figure 29:
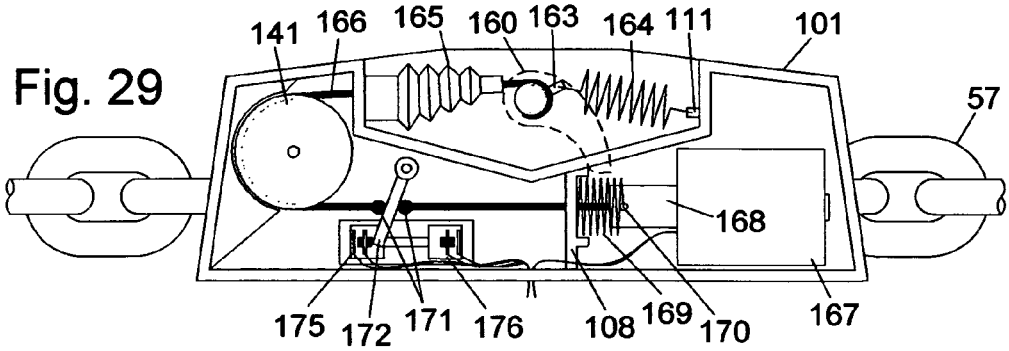
FIG. 29 is an elevation view of the first embodiment with pawl 160 in almost-locked position; chain 57 is additionally shown, but lid 103 and shield 104 are not shown.
Figure 30:
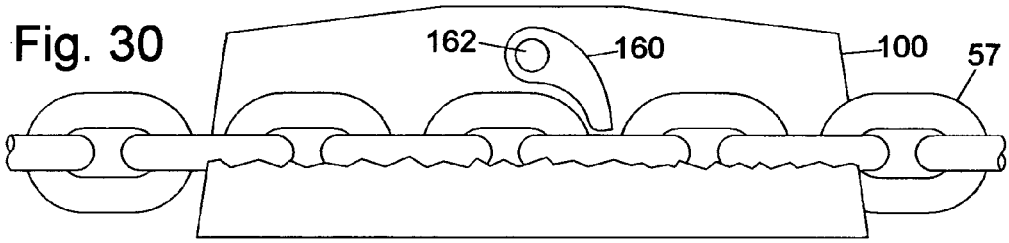
FIG. 30 is an elevation view of components of the first embodiment; shown are frame 100 in partial section, rod 162, and pawl 160 in almost-locked position; chain 57 is additionally shown.
Figure 31:
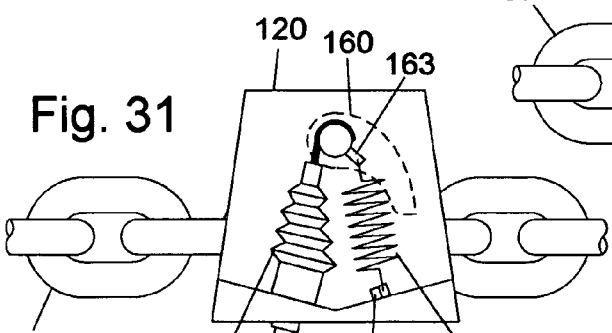
FIG. 31 is an elevation view of the second embodiment with pawl 160 in almost-locked position; chain 57 is additionally shown, but lid 123 and shield 124 are not shown.
Figure 31:
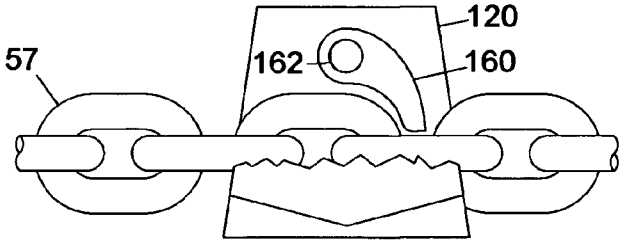
Figure 32:
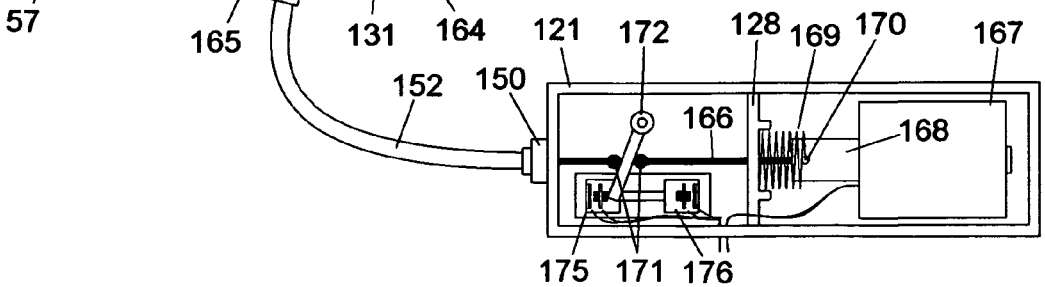
FIG. 32 is an elevation view of components of the second embodiment; shown are frame 120 in partial section, rod 162, and pawl 160 in almost-locked position; chain 57 is additionally shown.

FIGS. 29-32 are elevation views illustrating embodiments of the invention in which pawl 160 is in almost-locked position. FIGS. 29 and 30 show the first embodiment. In particular, FIG. 29 shows this embodiment without lid 103 and shield 104; and FIG. 30 shows frame 100 in partial section, rod 162, and pawl 160. FIGS. 31 and 32 show the second embodiment. In particular, FIG. 31 shows this embodiment without lid 123 and shield 124; and FIG. 32 shows frame 120 in partial section, rod 162, and pawl 160.

When pawl 160 is in almost-locked position, chain 57 is free to move longitudinally toward windlass 58. Chain 57 is also free to move away from windlass 58, but only for a very short distance, because as chain 57 moves away from windlass 58, pawl 160 catches against one of the vertical links and rotates into locked position, as shown in FIGS. 21-24. In this position, neither lock contact switch 175 nor unlock contact switch 176 is closed. In almost-locked position, pawl 160 does not relieve strain from windlass 58.

Embodiments of the present invention include several components that are forceful, insofar that they are capable of applying force. Forceful components include tension spring 164, solenoid 167, compression spring 169, lock contact switch 175, and unlock contact switch 176. In addition, chain 57 can convey force in one direction from windlass 58 and in the opposite direction from anchor 56 when buried in the seabed. These forces interact with each other due to the arrangement of components in embodiments of the invention.

As explained above, the force on anchor 56, when buried, may be greater than that exertable by windlass 58, which necessitates use of the boat's engines when hauling in anchor. Preferably, forceful components for embodiments of the present invention are selected so that their applied forces relative to each other, when modulated by their preferred arrangement, maintain the following properties, with reference to FIGS. 7 and 10:

(a) Combined forces from compression spring 169 and solenoid 167, when energized, exceed combined forces from tension spring 164 and unlock contact switch 176.

(b) Force from tension spring 164 exceeds force from compression spring 169.

(c) Combined forces from compression spring 169 and lock contact switch 175 exceed force from tension spring 164.

(d) Force from anchor 56, conveyed via chain 57, exceeds combined forces from compression spring 169, lock contact switch 175, and—optionally—solenoid 167 when energized.

(e) Force from compression spring 169 is sufficient to keep cable 166 taut.

As a consequence of property (a), when solenoid 167 is energized and pawl 160 is not impeded by chain 57, pawl 160 rotates away from chain 57, and unlock contact switch 176 closes. The resulting arrangement of components is illustrated in FIGS. 17-20.

As a consequence of property (b), when solenoid 167 is not energized, pawl 160 is urged toward chain 57. The resulting arrangement of components is illustrated primarily in FIGS. 25-28 and also in FIGS. 29-32.

As a consequence of property (c), when solenoid 167 is not energized and pawl 160 is not held firmly in place by chain 57 under force from anchor 56, lock contact switch 175 is open. The resulting arrangement of components is illustrated primarily in FIGS. 29-32 and also in FIGS. 25-28.

As a consequence of property (d), when pawl 160 is held firmly in place by chain 57 under force from anchor 56, lock contact switch 175 is closed. The resulting arrangement of components is illustrated in FIGS. 21-24. As an option, solenoid 167 may be sufficiently weak that lock contact switch 175 remains closed even when solenoid 167 is energized. This option demonstrates an advantage of the present invention, namely that solenoid 167 is permitted to be fairly weak and therefore inexpensive.

As a consequence of property (e), cable 166 remains taut even when solenoid 167 is not energized and when compression spring 164 is inhibited from applying force to cable 166 because a link of chain 57 blocks the rotation of pawl 160, as shown in FIGS. 25-28. Keeping cable 166 taut helps prevent snagging on other components.

As a further consequence of properties (b) and (d), embodiments of the present invention continue to provide safety under conditions of electrical failure. When solenoid 167 is not energized because of electrical failure, pawl 160 is urged toward chain 57, typically in an intermediate position as shown in FIGS. 25-28. If windlass 58 accidentally releases a length of anchor chain 57, longitudinal movement of chain 57 pulls pawl 160 into locked position, as shown in FIGS. 21-24. This impedes further movement of chain 57 and thereby restrains anchor 56 from launching.

8. EMBODIMENTS

Operation Procedures

FIGS. 33-41 are flow diagrams illustrating preferred steps in the operation of embodiments of the present invention. Operational methods for the two featured embodiments are described together, because these methods are substantially similar for both embodiments.

Figure 33:
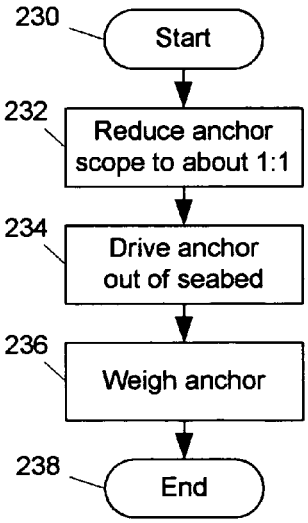
FIG. 33 is a flow diagram showing preferred steps performed in hauling in anchor.

FIG. 33 illustrates steps performed in a preferred method for hauling in anchor. For purposes of explanation, we will assume that anchor 56 is deployed and firmly dug into the seabed. The method begins at step 230. In step 232, the scope of anchor chain 57 is reduced to approximately 1:1, preferably by means of one of the methods described below and illustrated in FIG. 38 or FIG. 41. After completion of step 232, anchor 56 is almost directly beneath boat 50. Then, in step 234, anchor 56 is driven out of the seabed by using the boat's engines to move the boat away from the location in the seabed at which anchor 56 is buried. Once anchor 56 is free of the seabed, in step 236, anchor 56 is weighed, preferably by means of a method described below and illustrated in FIG. 35. The method ends at step 238.

Figure 34:
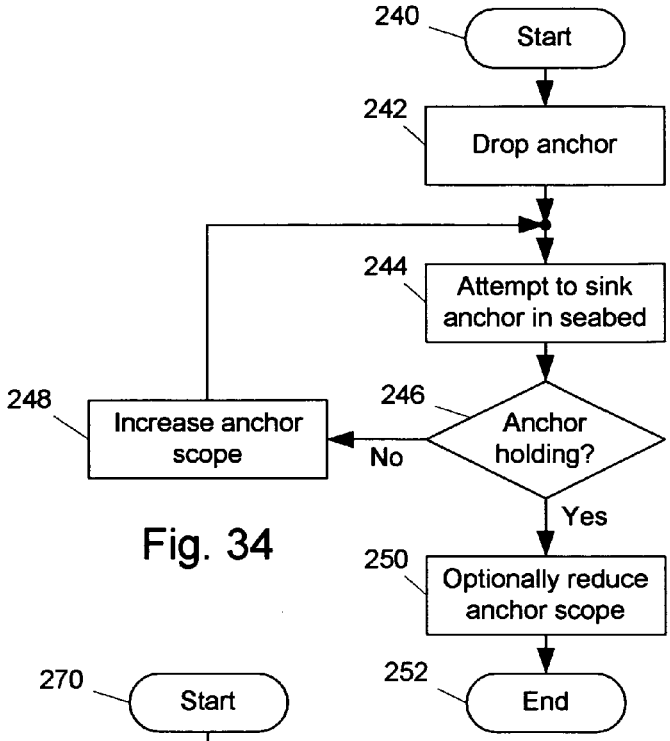
FIG. 34 is a flow diagram showing preferred steps performed in anchoring.

FIG. 34 illustrates steps performed in a preferred method for anchoring. The method begins at step 240. In step 242, anchor 56 is dropped, preferably by means of one of the methods described below and illustrated in FIG. 36 or FIG. 39. Step 244 attempts to sink anchor 56 into the seabed. Depending on anchoring conditions, this step might require putting the engines in reverse, or it might require only putting the engines in neutral and letting the wind or current pull the boat to dig the anchor in. Step 246 determines whether anchor 56 is holding. If anchor 56 is not holding, then in step 248, anchor scope is increased, preferably by means of one of the methods described below and illustrated in FIG. 37 or FIG. 40. After step 248, the method continues with step 244 described above. If step 246 determines that anchor 56 is holding, then step 250 optionally reduces anchor scope, preferably by means of one of the methods described below and illustrated in FIG. 38 or FIG. 41. The method ends at step 252.

The steps of the flow diagrams in FIGS. 35-41 are explained with reference to FIGS. 17-32 described above.

Figure 35:
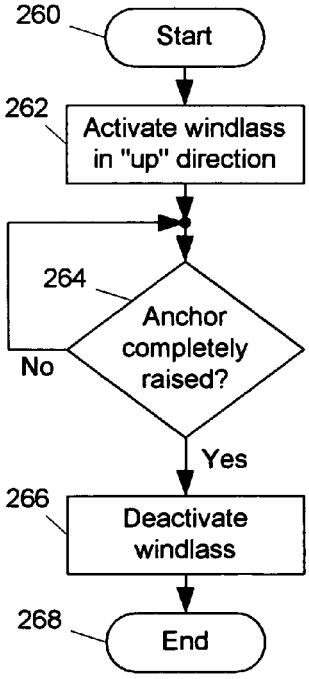
FIG. 35 is a flow diagram showing preferred steps performed in weighing an anchor in accordance with embodiments of the invention.
Figure 36:
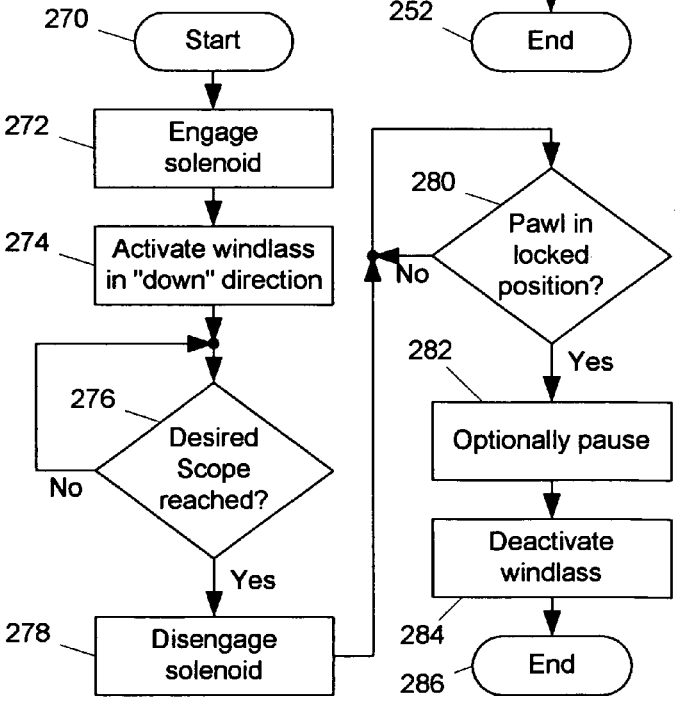
FIG. 36 is a flow diagram showing preferred steps performed in dropping an anchor in accordance with embodiments of the invention.

FIG. 35 illustrates steps performed in a preferred method for weighing anchor. For purposes of illustration, pawl 160 is assumed to begin in locked position, as shown in FIGS. 21-24, since this is the appropriate position for pawl 160 when boat 50 is laying at anchor. The method begins at step 260. In step 262, windlass 58 is activated in the "up" direction, meaning the direction that causes chain 57 to move longitudinally toward windlass 58. Step 264 determines whether anchor 56 is completely raised. This determination may be made by visual inspection, by mechanical detection means, by measuring the length of chain 57 deployed, or by other means. If necessary, step 264 repeatedly checks the status of anchor 56. Once anchor 56 is determined to be completely raised, step 266 deactivates windlass 58. The method ends at step 268. Note the absence of a step for fastening a safety cable or similar device to prevent accidental launching of the anchor. No such step is necessary, because at the end of the procedure, pawl 160 is in an intermediate position, such as that shown in FIGS. 25-28. As described above, in such a position, chain 57 is free to move only a short distance away from windlass 58; thus, anchor 56 is restrained from launching FIG. 36 illustrates steps performed in a preferred method for dropping anchor. For purposes of illustration, pawl 160 is assumed to begin in an intermediate position, such as that shown in FIGS. 25-28, since this is the typical position for pawl 160 when anchor 56 is completely raised. The method begins at step 270. In step 272, solenoid 167 is engaged, thereby rotating pawl 160 into unlocked position, as shown in FIGS. 17-20. In step 274, windlass 58 is activated in the "down" direction, meaning the direction that causes chain 57 to move longitudinally away from windlass 58. Step 276 determines whether the desired anchor scope has been reached. Appropriate anchor scope is affected by water depth, type of seabed, type of anchor, current, wind, and other factors. Typically, human judgment is used to determine what anchor scope is desired, but other means could be employed for this purpose, such as a software computation based on sonar data, means for detecting the angle of anchor rode, and so forth. If necessary, step 276 repeatedly checks the desirability of the anchor scope. Once the anchor scope has reached the desired point, step 278 disengages solenoid 167, thereby allowing pawl 160 to rotate into an intermediate position, such as that shown in FIGS. 25-28. Step 280 then determines whether pawl 160 is in locked position. This determination may be made by visual inspection of lock LED 184, by microcontroller 190 sensing an input port 193, or by other means. If necessary, step 280 repeatedly checks the position of pawl 160. Once pawl 160 is in locked position, as shown in FIGS. 21-24, step 282 optionally pauses to permit slack to develop in chain 57 between windlass 58 and pawl 160. Step 284 deactivates windlass 58, after which the method ends at step 286.

Figure 37:
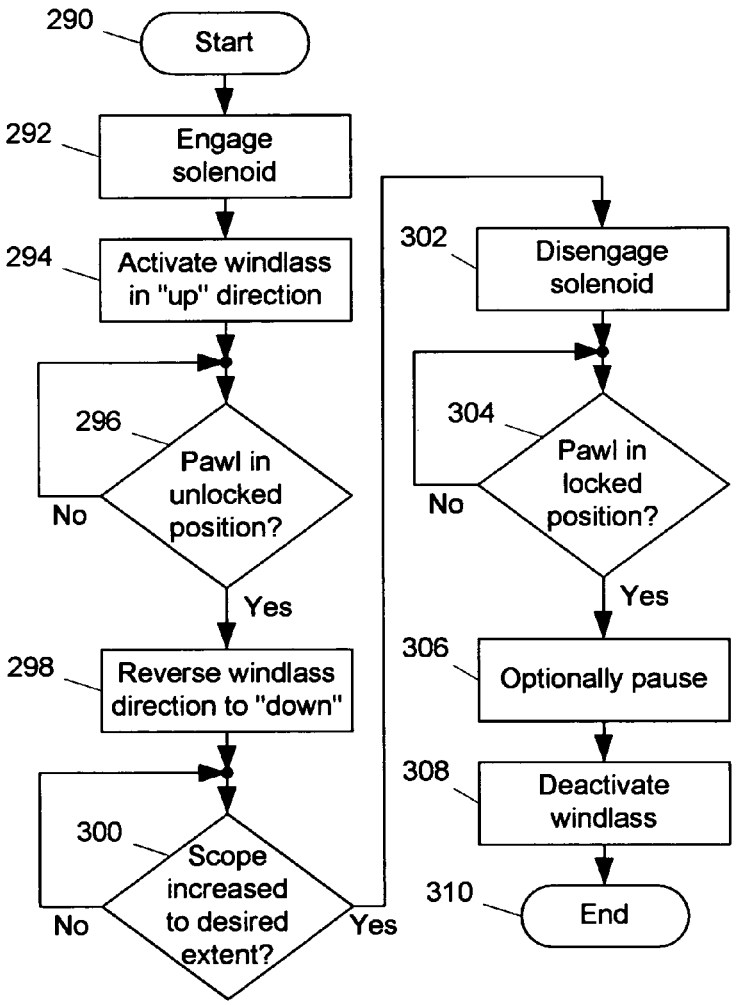
FIG. 37 is a flow diagram showing preferred steps performed in increasing anchor scope in accordance with embodiments of the invention.

FIG. 37 illustrates steps performed in a preferred method for increasing anchor scope. For purposes of illustration, pawl 160 is assumed to begin in locked position, as shown in FIGS. 21-24, since this is the appropriate position for pawl 160 when boat 50 is laying at anchor. The method begins at step 290. In step 292, solenoid 167 is engaged. Because pawl 160 is held by chain 57, pawl 160 typically remains in locked position even though solenoid 167 is engaged. In step 294, windlass 58 is activated in the "up" direction, which relieves the pressure of chain 57 against pawl 160, thereby permitting pawl 160 to rotate into unlocked position, as shown in FIGS. 17-20. Step 296 determines whether pawl 160 is in unlocked position. This determination may be made by visual inspection of unlock LED 185, by microcontroller 190 sensing an input port 193, or by other means. If necessary, step 296 repeatedly checks the position of pawl 160. Once pawl 160 is in unlocked position, step 298 reverses windlass 58 to the "down" direction. Step 300 determines whether the anchor scope has been increased to the desired extent. If necessary, step 300 repeatedly checks the desirability of the anchor scope. Once the anchor scope has been increased to the desired extent, step 302 disengages solenoid 167, thereby allowing pawl 160 to rotate into an intermediate position, such as that shown in FIGS. 25-28. Step 304 then determines whether pawl 160 is in locked position. This determination may be made by visual inspection of lock LED 184, by microcontroller 190 sensing an input port 193, or by other means. If necessary, step 304 repeatedly checks the position of pawl 160. Once pawl 160 is in locked position, as shown in FIGS. 21-24, step 306 optionally pauses to permit slack to develop in chain 57 between windlass 58 and pawl 160. Step 308 deactivates windlass 58, after which the method ends at step 310.

Figure 38:
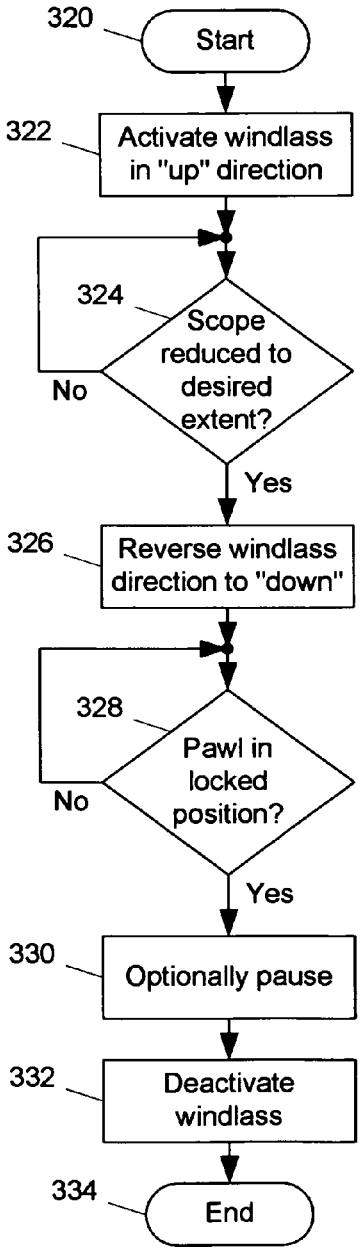
FIG. 38 is a flow diagram showing preferred steps performed in reducing anchor scope in accordance with embodiments of the invention.

FIG. 38 illustrates steps performed in a preferred method for reducing anchor scope. For purposes of illustration, pawl 160 is assumed to begin in locked position, as shown in FIGS. 21-24, since this is the appropriate position for pawl 160 when boat 50 is laying at anchor. The method begins at step 320. In step 322, windlass 58 is activated in the "up" direction. As chain 57 is pulled by windlass 58, pawl 160 rotates into an intermediate position, such as that shown in FIGS. 25-28. Step 324 determines whether the anchor scope has been reduced to the desired extent. If necessary, step 324 repeatedly checks the desirability of the anchor scope. Once the anchor scope has been reduced to the desired extent, step 326 reverses windlass 58 to the "down" direction. Step 328 then determines whether pawl 160 is in locked position. This determination may be made by visual inspection of lock LED 184, by microcontroller 190 sensing an input port 193, or by other means. If necessary, step 328 repeatedly checks the position of pawl 160. Once pawl 160 is in locked position, as shown in FIGS. 21-24, step 330 optionally pauses to permit slack to develop in chain 57 between windlass 58 and pawl 160. Step 332 deactivates windlass 58, after which the method ends at step 334.

As described above, some installations may omit wiring connections to lock contact switch 175 and unlock contact switch 176. For such installations, the methods illustrated in FIGS. 36-38 may be impeded by the lack of an indication of the position of pawl 160. For such installations, the alternate methods illustrated in FIGS. 39-41, respectively, may be substituted for those illustrated in FIGS. 36-38. Note that the method for weighing anchor illustrated in FIG. 35 does not employ position indication; therefore, no alternate method for weighing anchor is presented below.

Figure 39:
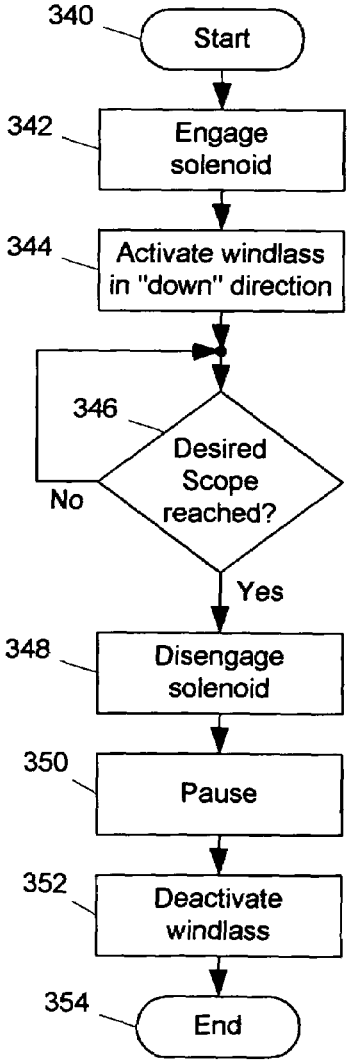
FIG. 39 is a flow diagram showing preferred steps performed in dropping an anchor in accordance with embodiments of the invention without position indication.

FIG. 39 illustrates steps performed in an alternate method for dropping anchor, which is preferably employed when position indication is not available. For purposes of illustration, pawl 160 is assumed to begin in an intermediate position, such as that shown in FIGS. 25-28, since this is the typical position for pawl 160 when anchor 56 is completely raised. The method begins at step 340. In step 342, solenoid 167 is engaged, thereby rotating pawl 160 into unlocked position, as shown in FIGS. 17-20. In step 344, windlass 58 is activated in the "down" direction. Step 346 determines whether the desired anchor scope has been reached. If necessary, step 346 repeatedly checks the desirability of the anchor scope. Once the anchor scope has reached the desired point, step 348 disengages solenoid 167, thereby allowing pawl 160 to rotate into an intermediate position, such as that shown in FIGS. 25-28. Step 350 then pauses for a predetermined duration to allow time for pawl 160 to rotate into locked position, as shown in FIGS. 21-24. Step 350 may optionally include sufficient time for slack to develop in chain 57 between windlass 58 and pawl 160. Step 352 then deactivates windlass 58, after which the method ends at step 354.

Figure 40:
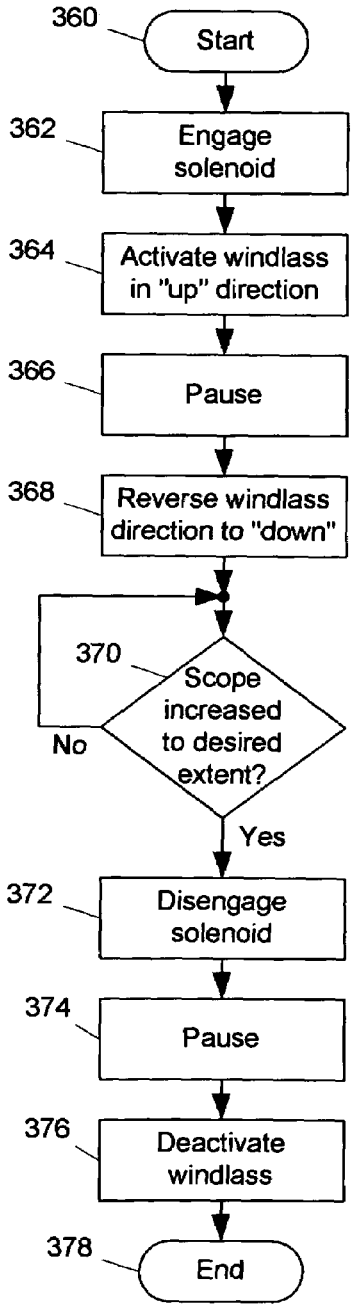
FIG. 40 is a flow diagram showing preferred steps performed in increasing anchor scope in accordance with embodiments of the invention without position indication.

FIG. 40 illustrates steps performed in an alternate method for increasing anchor scope, which is preferably employed when position indication is not available. For purposes of illustration, pawl 160 is assumed to begin in locked position, as shown in FIGS. 21-24, since this is the appropriate position for pawl 160 when boat 50 is laying at anchor. The method begins at step 360. In step 362, solenoid 167 is engaged. Because pawl 160 is held by chain 57, pawl 160 typically remains in locked position even though solenoid 167 is engaged. In step 364, windlass 58 is activated in the "up" direction, which relieves the pressure of chain 57 against pawl 160, and step 366 then pauses for a predetermined duration to allow time for pawl 160 to rotate into unlocked position, as shown in FIGS. 17-20. Step 368 reverses windlass 58 to the "down" direction. Step 370 determines whether the anchor scope has been increased to the desired extent. If necessary, step 370 repeatedly checks the desirability of the anchor scope. Once the anchor scope has been increased to the desired extent, step 372 disengages solenoid 167, thereby allowing pawl 160 to rotate into an intermediate position, such as that shown in FIGS. 25-28. Step 374 then pauses for a predetermined duration to allow time for pawl 160 to rotate into locked position, as shown in FIGS. 21-24. Step 374 may optionally include sufficient time for slack to develop in chain 57 between windlass 58 and pawl 160. Step 376 then deactivates windlass 58, after which the method ends at step 378.

Figure 41:
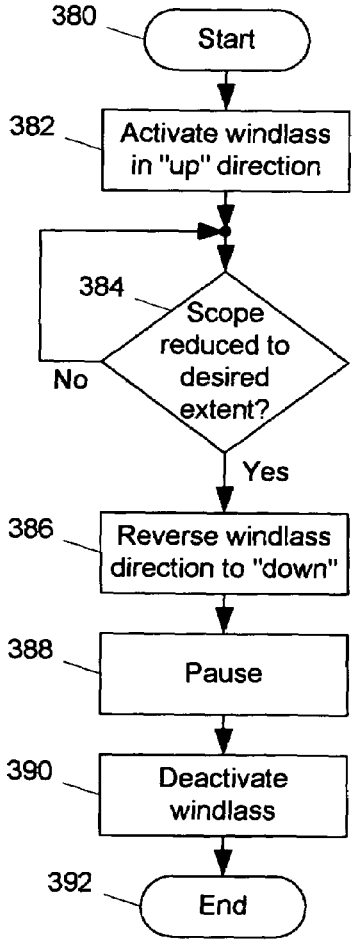
FIG. 41 is a flow diagram showing preferred steps performed in reducing anchor scope in accordance with embodiments of the invention without position indication.

FIG. 41 illustrates steps performed in an alternate method for reducing anchor scope, which is preferably employed when position indication is not available. For purposes of illustration, pawl 160 is assumed to begin in locked position, as shown in FIGS. 21-24, since this is the appropriate position for pawl 160 when boat 50 is laying at anchor. The method begins at step 380. In step 382, windlass 58 is activated in the "up" direction. As chain 57 is pulled by windlass 58, pawl 160 rotates into an intermediate position, such as that shown in FIGS. 25-28. Step 384 determines whether the anchor scope has been reduced to the desired extent. If necessary, step 384 repeatedly checks the desirability of the anchor scope. Once the anchor scope has been reduced to the desired extent, step 386 reverses windlass 58 to the "down" direction. Step 388 then pauses for a predetermined duration to allow time for pawl 160 to rotate into locked position, as shown in FIGS. 21-24. Step 388 may optionally include sufficient time for slack to develop in chain 57 between windlass 58 and pawl 160. Step 390 deactivates windlass 58, after which the method ends at step 392.

9. ALTERNATE ASSEMBLIES

As illustrated in FIG. 10, the second embodiment is preferably configured with niche 134 on the port side of frame 120. This is an appropriate configuration for most vessels, because most boats have at least as much available foredeck space to port of the anchor chain as they have to starboard. This, in turn, is because vertical-spindle windlasses typically pay out and retract chain to starboard, so the bulk of the windlass is to port of the chain. However, in some installations, it is possible that more foredeck space may be available to starboard than to port. For such installations, the second embodiment of the present invention may be configured with niche 134 on the starboard side of frame 120, as illustrated in FIG. 42, in which lid 123, gasket 122, and shield 124 are omitted for clarity and compactness of illustration.

Figure 42:
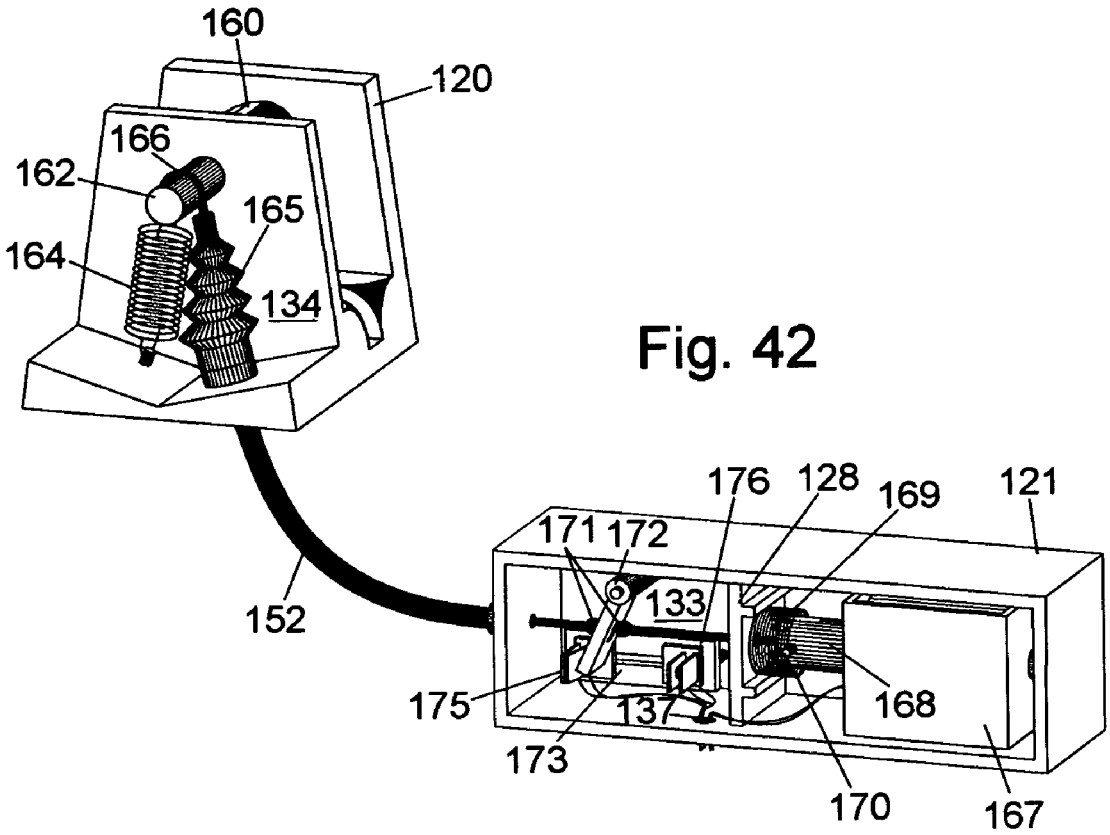
FIG. 42 is a perspective view of the second embodiment, configured with the niche on the starboard side of the frame; lid 123, gasket 122, and shield 124 are not shown.

The alternate configuration shown in FIG. 42 may be formed from the configuration shown in FIG. 10 by reversing the orientation of pawl 160, by approximately swapping the location of fixed pin 131 with the location of cable ingress 151 and ferrule 130, and by connecting tension spring 164 and bellows 165 as illustrated.

It is a straightforward to manufacture frame 120 so that it can be configured with niche 134 to either side. Preferably, frame 120 can accommodate fixed pin 131 in either of the positions shown in FIGS. 10 and 42. In like manner, frame 120 can preferably accommodate cable ingress 151 and ferrule 130 in either of the positions shown in FIGS. 10 and 42. Thus, the second embodiment can be configured with niche 134 on either the port side or the starboard side of frame 120.

As illustrated in FIG. 7, the first embodiment is preferably configured with housing 101 to port of frame 100. This is an appropriate configuration for most vessels, because most boats have at least as much available foredeck space to port of the anchor chain as they have to starboard, as described above. However, in some installations, it is possible that more foredeck space may be available to starboard than to port. For such installations, the first embodiment of the present invention may be configured with housing 101 to starboard of frame 100, as illustrated in FIG. 43, in which lid 103, gasket 102, and shield 104 are omitted for clarity and compactness of illustration.

Figure 43:
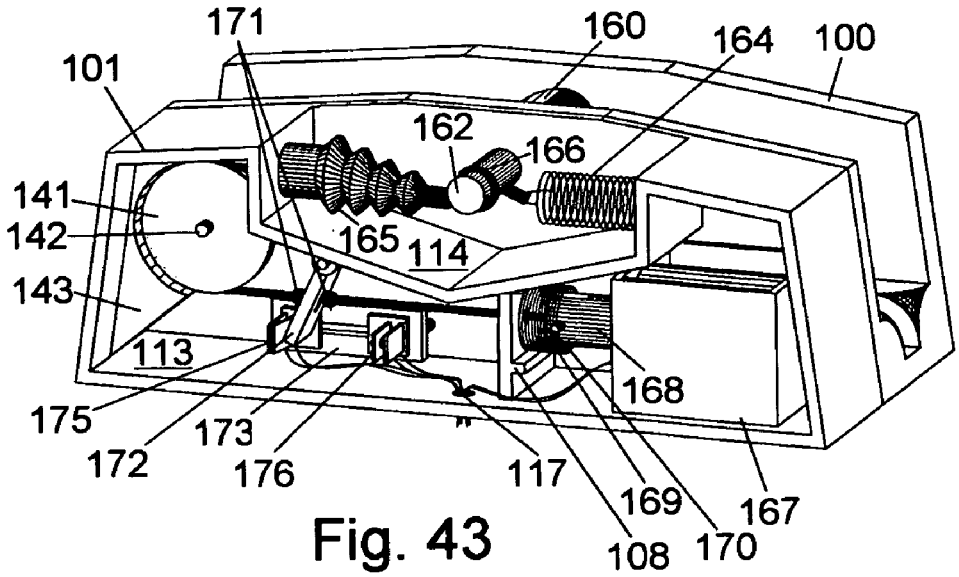
FIG. 43 is a perspective view of the first embodiment, configured with the housing to starboard of the frame; lid 103, gasket 102, and shield 104 are not shown.

The alternate configuration shown in FIG. 43 may be formed from the configuration shown in FIG. 7 by reversing the orientation of pawl 160 and by connecting tension spring 164 and bellows 165 as illustrated.

10. CONCLUSION, RAMIFICATIONS, AND SCOPE OF INVENTION

Thus, the reader will see that the invention provides a device that secures anchor chain under control from one or more remote locations, without excessive weight and expense, and is thus suitable for use on mid-sized watercraft. Using the invention, the operator of a boat can remotely stop and release an anchor chain repeatedly, without having to manually reset the device. The device also provides remote indication of whether the chain is secured and whether the chain is free to move. The device can be controlled electronically by an automated anchoring system.

In addition to providing remote control and indication, the invention provides a single mechanism that obviates functions of two separate prior-art devices: a chain stopper or other device for relieving strain on a windlass, and a safety cable or other device for restraining an anchor from accidentally launching.

The invention provides remote control without re-routing the anchor chain and without a mechanically restrictive connection between the bow and the bridge.

By exploiting the presence of a powered windlass to perform some steps of the anchoring procedure, the invention enables the use of a solenoid, which is a weak actuator relative to the hydraulic or pneumatic actuators used in the prior art. The invention further derives power for its solenoid by exploiting the electrical power typically available in the bow of mid-size boats for the primary purpose of powering a windlass.

The invention provides fail safety, in that it continues to restrain an anchor and relieve windlass strain even under conditions of electrical failure. The invention also includes protection for its sensitive components, so that it can tolerate mechanical shocks and the presence of water.

While the above invention includes many specificities, these should not be construed as limitations on the scope of the invention, but rather as an exemplification of preferred embodiments thereof. Many other variations are possible. Accordingly, the scope of the invention should be determined not by the embodiments illustrated, but by the appended claims and their legal equivalents.

The invention claimed is:

1. A device for mechanically securing an anchor chain on a watercraft, comprising:

(a) a frame mechanically attachable to said watercraft, (b) a pawl rotatably mounted in said frame, (c) an elastic actuator mechanically coupled to said pawl, (d) a solenoid mechanically coupled to said pawl, and (e) a primary control switch electrically coupled to said solenoid, so that (f) said anchor chain passes through said frame, (g) said pawl is capable of rotation to a locked position, thereby impeding longitudinal movement of said anchor chain in one direction, (h) said pawl is capable of rotation to an unlocked position, thereby permitting longitudinal movement of said anchor chain, (i) said elastic actuator urges said pawl toward said locked position, (j) said solenoid, when engaged, urges said pawl toward said unlocked position, and (k) said primary control switch, when closed, engages said solenoid, whereby said anchor chain is secured under control of said primary control switch, and under conditions of electrical failure, longitudinal movement of said anchor chain is impeded in one direction.

2. The device of claim 1, wherein said elastic actuator is a spring.

3. The device of claim 1, further comprising position-detection means mechanically coupled to said pawl, so that said position-detection means determine whether said pawl is in at least one position selected from the group consisting of said locked position and said unlocked position.

4. The device of claim 3, further comprising:

(a) a plurality of control switches, and (b) a plurality of indicating means, wherein (c) said primary control switch is one of said control switches, (d) each of said control switches is electrically coupled to said solenoid, and (e) each of said indicating means is electrically coupled to said position-detection means, so that (f) each of said control switches, when closed, engages said solenoid, (g) each of said indicating means indicates whether said pawl is in at least one position selected from the group consisting of said locked position and said unlocked position, whereby said anchor chain is secured under control of the plurality of said control switches, and the plurality of said indicating means indicate the position of said pawl.

5. The device of claim 3, further comprising a microcontroller, said microcontroller having a plurality of output ports and a plurality of input ports, wherein:

(a) said primary control switch is an electrically actuated switch, (b) at least one of said output ports of said microcontroller is electrically coupled to said primary control switch, and (c) said position-detection means are electrically coupled to at least one of said input ports of said microcontroller, so that (d) said microcontroller, by energizing said output port, engages said solenoid, and (e) said microcontroller, by sampling said input port, determines whether said pawl is in at least one position selected from the group consisting of said locked position and said unlocked position, whereby said anchor chain is secured under control of said microcontroller, and said microcontroller is able to determine the position of said pawl.

6. The device of claim 1, further comprising:

(a) a rod mechanically affixed to said pawl, and (b) a cable mechanically affixed to said solenoid and said rod, wherein (c) said pawl is rotatably mounted in said frame by means of said rod, and (d) said solenoid is mechanically coupled to said pawl by means of said rod and said cable, so that (e) said solenoid, when engaged, urges said cable to move longitudinally, (f) longitudinal movement of said cable causes said rod to rotate, and (g) rotation of said rod causes said pawl to rotate, whereby said solenoid, when engaged, urges said pawl toward said unlocked position.

7. The device of claim 6, further comprising:

(a) a paddle mechanically coupled to said cable, and (b) at least one position-detection switch, located so that said position-detection switch is closed when said paddle moves to a predetermined position, whereby the closure of said position-detection switch determines whether said pawl is in at least one position selected from the group consisting of said locked position and said unlocked position.

8. The device of claim 6, further comprising:

(a) a housing physically adjacent to said frame, the interior of said housing forming a chamber, (b) a lid mechanically attachable to said housing, and (c) bellows mechanically affixed to said housing and said cable, wherein (d) said solenoid is mounted inside said chamber, (e) said pawl and said rod are mounted outside said chamber, and (f) said cable passes from outside said chamber to inside said chamber, so that (g) said lid, when secured, inhibits entry of water into said chamber, (h) said bellows inhibits entry of water into said chamber, and (i) said bellows permits said cable to move longitudinally, whereby said solenoid is protected from damage due to water.

9. The device of claim 8, further comprising shielding means installed so as to at least partly encase at least one component selected from the group consisting of said bellows and said elastic actuator, whereby said component is protected from mechanical damage.

10. The device of claim 6, further comprising:

(a) a housing physically separated from said frame, the interior of said housing forming a chamber, (b) a lid mechanically attachable to said housing, (c) a cable jacket mechanically affixed to said housing, and (d) bellows mechanically affixed to said cable jacket and said cable, wherein (e) said solenoid is mounted inside said chamber, (f) said pawl and said rod are mounted outside said chamber, and (g) said cable passes from outside said chamber to inside said chamber, so that (h) said lid, when secured, inhibits entry of water into said chamber, (i) said bellows and said cable jacket inhibit entry of water into said chamber, (j) said cable jacket routs said cable between said bellows and said chamber, and (k) said bellows permits said cable to move longitudinally, whereby said solenoid is protected from damage due to water.

11. The device of claim 10, further comprising shielding means installed so as to at least partly encase at least one component selected from the group consisting of said bellows and said elastic actuator, whereby said component is protected from mechanical damage.

12. On a watercraft having an anchor, an anchor chain, and a windlass, wherein said anchor is mechanically attached to said anchor chain and said windlass is configured to longitudinally move said anchor chain, a method for securing said anchor chain, comprising:

(a) mechanically attaching a frame to said watercraft, (b) rotatably mounting a pawl in said frame, (c) mechanically coupling an elastic actuator to said pawl, (d) mechanically coupling a solenoid to said pawl, (e) electrically coupling a control switch to said solenoid, (f) passing said anchor chain through said frame, (g) configuring said pawl to be capable of rotation to a locked position, thereby impeding longitudinal movement of said anchor chain away from said windlass, (h) configuring said pawl to be capable of rotation to an unlocked position, thereby permitting longitudinal movement of said anchor chain, (i) configuring said elastic actuator to urge said pawl toward said locked position, (j) configuring said solenoid to, when engaged, urge said pawl toward said unlocked position, and (k) configuring said control switch to, when closed, engage said solenoid, whereby said anchor chain is secured under control of said control switch, and under conditions of electrical failure, longitudinal movement of said anchor chain away from said windlass is impeded.

13. The method of claim 12, further including steps for weighing anchor, said steps comprising:

(a) activating said windlass to cause longitudinal movement of said anchor chain toward said windlass, (b) determining whether said anchor chain is fully retracted, and (c) when said anchor is fully retracted, deactivating said windlass, whereby once said anchor is fully raised, said anchor is protected from accidental release by said pawl, which is urged by said elastic actuator to impede longitudinal movement of said anchor chain away from said windlass.

14. The method of claim 12, further including steps for dropping anchor, said steps comprising:

(a) engaging said solenoid, thereby urging said pawl to said unlocked position, (b) activating said windlass to cause longitudinal movement of said anchor chain away from said windlass, (c) determining whether said anchor chain is extended to desired extent, (d) when said anchor chain is extended to desired extent, disengaging said solenoid, thereby permitting said elastic actuator to urge said pawl toward said locked position, (e) pausing for a predetermined time of sufficient duration for said longitudinal movement of said anchor chain to cause said pawl to rotate into said locked position, and (f) deactivating said windlass, whereby once said anchor chain is extended to desired extent and said pawl is in said locked position, if said anchor applies a strain to said anchor chain, then said pawl, by virtue of being in said locked position, relieves said windlass of said strain.

15. The method of claim 12, further including steps for increasing anchor scope, said steps comprising:

(a) engaging said solenoid, thereby urging said pawl toward said unlocked position, (b) activating said windlass to cause longitudinal movement of said anchor chain toward said windlass, (c) pausing for a predetermined time of sufficient duration for said longitudinal movement of said anchor chain to permit said pawl to rotate into said unlocked position, and (d) reversing direction of said windlass to cause longitudinal movement of said anchor chain away from said windlass, (e) determining whether said anchor chain is extended to desired extent, (f) when said anchor chain is extended to desired extent, disengaging said solenoid, thereby permitting said elastic actuator to urge said pawl toward said locked position, (g) pausing for a predetermined time of sufficient duration for said longitudinal movement of said anchor chain to cause said pawl to rotate into said locked position, and (h) deactivating said windlass, whereby once said anchor chain is extended to desired extent and said pawl is in said locked position, if said anchor applies a strain to said anchor chain, then said pawl, by virtue of being in said locked position, relieves said windlass of said strain.

16. The method of claim 12, further including steps for decreasing anchor scope, said steps comprising:

(a) activating said windlass to cause longitudinal movement of said anchor chain toward said windlass, (b) determining whether said anchor chain is retracted to desired extent, (c) when said anchor chain is retracted to desired extent, reversing direction of said windlass to cause longitudinal movement of said anchor chain away from said windlass, (d) pausing for a predetermined time of sufficient duration for said longitudinal movement of said anchor chain to cause said pawl to rotate into said locked position, and (e) deactivating said windlass, whereby once said anchor chain is retracted to desired extent and said pawl is in said locked position, if said anchor applies a strain to said anchor chain, then said pawl, by virtue of being in said locked position, relieves said windlass of said strain.

17. The method of claim 12, further comprising:

(a) mechanically coupling position-detection means to said pawl, (b) determining, by use of said position-detection means, whether said pawl is in at least one position selected from the group consisting of said locked position and said unlocked position.

18. The method of claim 17, further including steps for dropping anchor, said steps comprising:

(a) engaging said solenoid, thereby urging said pawl to said unlocked position, (b) activating said windlass to cause longitudinal movement of said anchor chain away from said windlass, (c) determining whether said anchor chain is extended to desired extent, (d) when said anchor chain is extended to desired extent, disengaging said solenoid, thereby permitting said elastic actuator to urge said pawl toward said locked position, (e) determining whether said pawl is in said locked position, and (f) when said pawl is in said locked position, deactivating said windlass, whereby once said anchor chain is extended to desired extent and said pawl is in said locked position, if said anchor applies a strain to said anchor chain, then said pawl, by virtue of being in said locked position, relieves said windlass of said strain.

19. The method of claim 17, further including steps for increasing anchor scope, said steps comprising:

(a) engaging said solenoid, thereby urging said pawl toward said unlocked position, (b) activating said windlass to cause longitudinal movement of said anchor chain toward said windlass, (c) determining whether said pawl is in said unlocked position, (d) when said pawl is in said unlocked position, reversing direction of said windlass to cause longitudinal movement of said anchor chain away from said windlass, (e) determining whether said anchor chain is extended to desired extent, (f) when said anchor chain is extended to desired extent, disengaging said solenoid, thereby permitting said elastic actuator to urge said pawl toward said locked position, (g) determining whether said pawl is in said locked position, and (h) when said pawl is in said locked position, deactivating said windlass, whereby once said anchor chain is extended to desired extent and said pawl is in said locked position, if said anchor applies a strain to said anchor chain, then said pawl, by virtue of being in said locked position, relieves said windlass of said strain.

20. The method of claim 17, further including steps for decreasing anchor scope, said steps comprising:

(a) activating said windlass to cause longitudinal movement of said anchor chain toward said windlass, (b) determining whether said anchor chain is retracted to desired extent, (c) when said anchor chain is retracted to desired extent, reversing direction of said windlass to cause longitudinal movement of said anchor chain away from said windlass, (d) determining whether said pawl is in said locked position, and (e) when said pawl is in said locked position, deactivating said windlass, whereby once said anchor chain is retracted to desired extent and said pawl is in said locked position, if said anchor applies a strain to said anchor chain, then said pawl, by virtue of being in said locked position, relieves said windlass of said strain.

* * * * *